US010146178B2

(12) United States Patent
Murata et al.

(10) Patent No.: US 10,146,178 B2
(45) Date of Patent: Dec. 4, 2018

(54) IMAGE FORMING APPARATUS THAT COOLS INSIDE OF APPARATUS

(71) Applicant: KYOCERA Document Solutions Inc., Osaka (JP)

(72) Inventors: Takahiko Murata, Osaka (JP); Makoto Egi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/819,497

(22) Filed: Nov. 21, 2017

(65) Prior Publication Data

US 2018/0150026 A1 May 31, 2018

(30) Foreign Application Priority Data

Nov. 28, 2016 (JP) ..... 2016-230664

(51) Int. Cl.

| | |
|---|---|
| ***G03G 15/00*** | (2006.01) |
| ***G03G 21/00*** | (2006.01) |
| ***G03G 21/20*** | (2006.01) |
| ***G03G 15/08*** | (2006.01) |
| *G03G 15/095* | (2006.01) |

(52) U.S. Cl.

CPC ..... *G03G 21/206* (2013.01); *G03G 15/0808* (2013.01); *G03G 15/50* (2013.01); *G03G 15/556* (2013.01); *G03G 15/0887* (2013.01); *G03G 15/095* (2013.01)

(58) Field of Classification Search

CPC .. G03G 21/20; G03G 21/206; G03G 15/0808; G03G 15/0942; G03G 15/095; G03G 15/50; G03G 15/556; G03G 15/0887

See application file for complete search history.

(56) References Cited

U.S. PATENT DOCUMENTS

2009/0285588 A1* 11/2009 Furuichi ..... G03G 21/206 399/27
2016/0116877 A1* 4/2016 Matsushita ..... G03G 15/50 399/53

(Continued)

FOREIGN PATENT DOCUMENTS

JP 2004-198783 A 7/2004
JP 2006-227557 A 8/2006

*Primary Examiner* — Sophia S Chen

(74) *Attorney, Agent, or Firm* — IP Business Solutions, LLC

(57) ABSTRACT

An image forming apparatus includes: an image carrier; a developing device forming a toner image on the image carrier; a transfer section arranged at downstream from the developing device in a rotation direction of the image carrier and transfers the toner image onto a recording sheet; a fixing section arranged at downstream from the transfer section in a conveyance direction of the recording sheet and fixes the toner image transferred to the recording sheet on the recording sheet; an air path guiding air taken from an outside of the image forming apparatus to the developing device; and a control section that, when operating the developing device under a cooling mode for cooling the developing device, controls the developing device and causes the developing device to reduce an amount of developer on a developing roller so as to be smaller than that of under image forming operation.

3 Claims, 18 Drawing Sheets

(56) References Cited

U.S. PATENT DOCUMENTS

| | | | | |
|---|---|---|---|---|
| 2016/0116885 | A1* | 4/2016 | Pearce | G03G 21/206 399/92 |
| 2017/0010582 | A1* | 1/2017 | Kojima | G03G 21/206 |

* cited by examiner

IMAGE FORMING APPARATUS THAT COOLS INSIDE OF APPARATUS

INCORPORATION BY REFERENCE

This application claims priority to Japanese Patent Application No. 2016-230664 filed on Nov. 28, 2016, the entire contents of which are incorporated by reference herein.

BACKGROUND

The present disclosure relates to image forming apparatuses, and particularly, to a technology for cooling an inside of the apparatus.

A general image forming apparatus has a drum type photoreceptor which serves as an image carrier, a charging section, an exposure section, a developing device, a transfer section, and a fixing section. Such the apparatus performs the following processes: a charging process in which the image carrier is charged; an exposure process in which an electrostatic latent image is formed on the image carrier by exposure; image forming process in which a toner image is formed by supplying toner to the electrostatic latent image; a transfer process in which the formed toner image is transferred onto a recording sheet; and a fixing process in which the toner image is fixed by a heat and a pressure. The photoreceptor is rotatably arranged, and the developing device and the fixing section respectively include a rotary member. When the photoreceptor and the rotary member rotate, a sliding-frictional heat is generated and an internal temperature of the apparatus rises.

To reduce an environmental load, low-temperature fixing toner having a fixing temperature lower than the conventional toner is adopted in recent technologies. Because the low-temperature fixing toner has low heat resistance, when image forming operations are continuously performed in a state where the internal temperature of an apparatus is high, the low-temperature fixing toner is thermally deteriorated due to thermal damage. Thermally deteriorated tonners cause problems in images or aggregate the toner, and sometimes even cause the apparatus to fail.

There are some technologies that adopt low friction members to sliding surfaces to suppress temperature rise. However, the temperature rise cannot be completely avoided. In this regard, technologies in which a cooling mode for cooling the inside of the apparatus, especially the developing device, is adopted have been suggested.

SUMMARY

As an aspect of the present disclosure, a further improved technology than the above technologies is proposed.

An image forming apparatus includes an image carrier, a developing device, a transfer section, a fixing section, an air path, and a control section.

The image carrier rotates about a rotation axis and carries a toner image on a surface of the image carrier.

The developing device supplies toner to the image carrier, and forms the toner image on the image carrier.

The transfer section is arranged at downstream from the developing device in a rotation direction of the image carrier, and transfers the toner image onto a recording sheet at a transfer nip part formed between the transfer section and the image carrier.

The fixing section is arranged at downstream from the transfer section in a conveyance direction of the recording sheet, and fixes the toner image having been transferred to the recording sheet on the recording sheet at a fixing nip part formed between a thermal roller and a compression roller.

The air path guides air taken from an outside of the image forming apparatus to the developing device.

When operating the developing device under a cooling mode for cooling the developing device, the control section controls the developing device and causes the developing device to perform an operation of reducing an amount of developer on a developing roller than that of under image forming operation.

BRIEF DESCRIPTION OF THE DRAWINGS

FIG. 4A is showing a state where an adjustment valve is being parallel to an upper surface of an inner wall of the air path: FIG. 4B is showing a state where a tip of the adjustment valve coming in contact with the inner wall of the air path.

Each FIG. 7A, FIG. 7B, FIG. 7C.

FIG. 9A is showing a state before a developing sleeve is rotated backward: FIG. 9B is showing a state after the developing sleeve has been rotated the backward.

FIG. 10A is showing a case where a cooling mode is released when the internal temperature becomes equals to or below a predetermined temperature: FIG. 10B is showing a case where the cooling mode is released when a predetermined time elapsed from a setting of the cooling mode.

FIG. 4A is showing a state where a first oblique side section is being parallel to the inner wall of the air path: FIG. 14B is showing a state where a second oblique side section is coming near the inner wall of the air path: FIG. 14C is showing a state where a tip of the first oblique side section coming in contact with the inner wall of the air path.

FIG. 16A is a schematic diagram when viewed from above: FIG. 16B is a schematic diagram when viewed from front.

FIG. 17A is a schematic diagram when viewed from above: FIG. 17B is a schematic diagram when viewed from front.

DETAILED DESCRIPTION

Hereinafter, a description will be given of an image forming apparatus according to embodiments as one aspect of the present disclosure with reference to the drawings.

Figure 1:
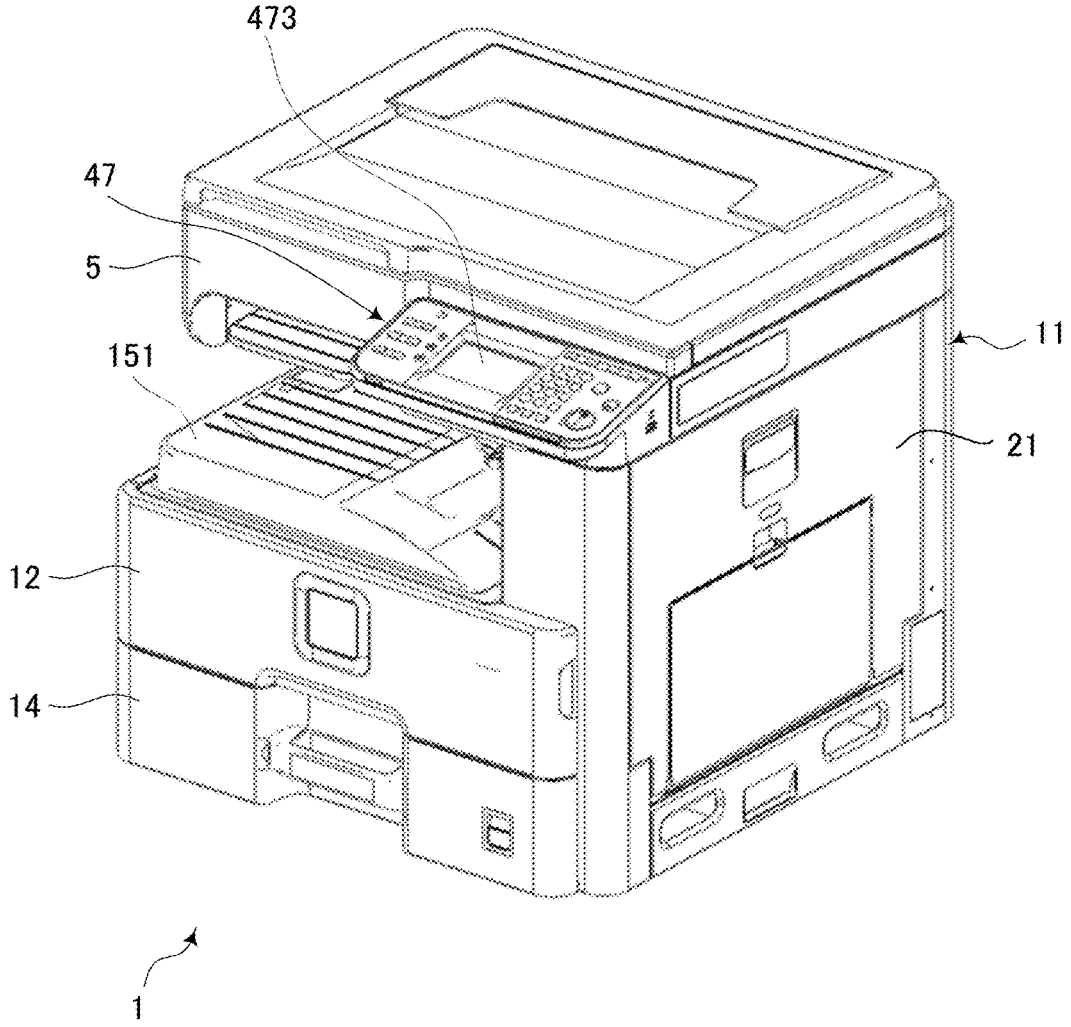
FIG. 1 is a front side perspective view showing an appearance of an image forming apparatus according to a first embodiment of the present disclosure.
Figure 2:
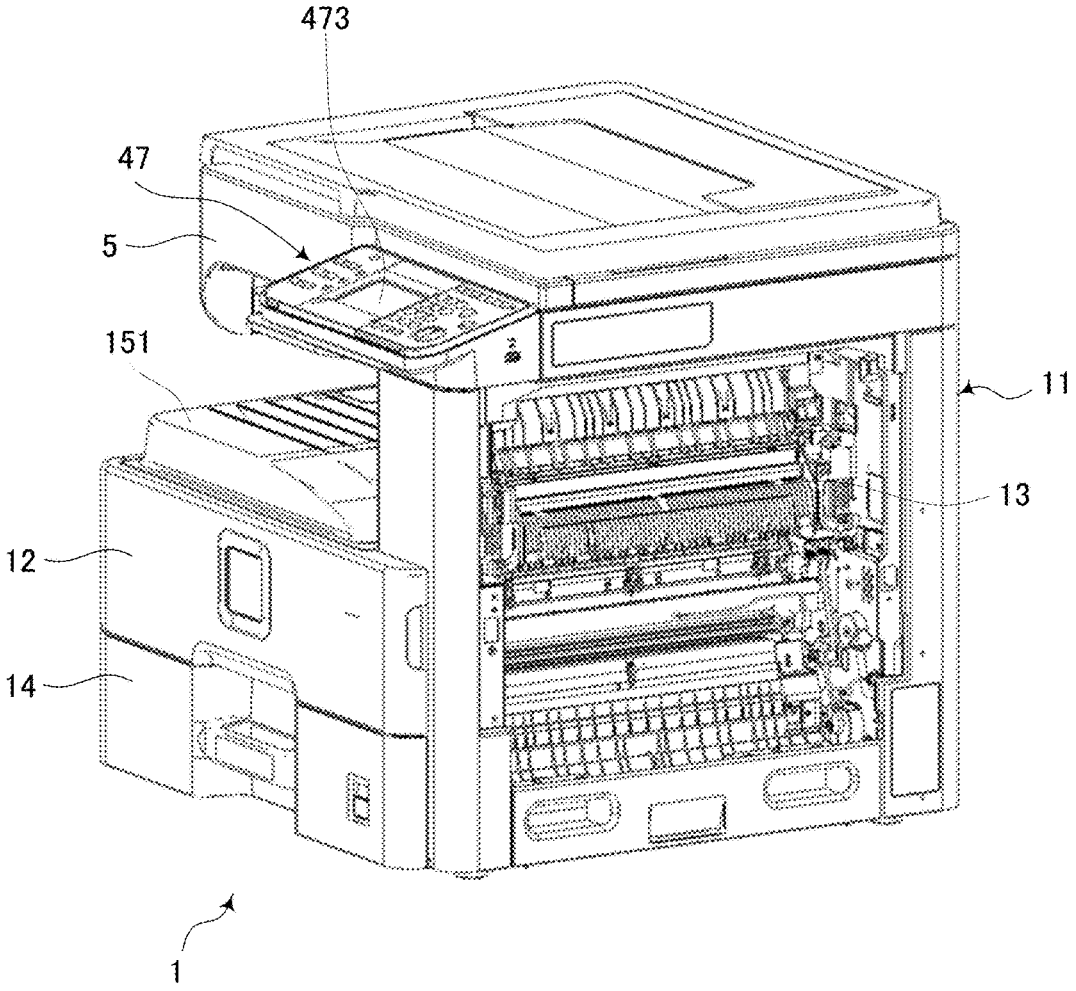
FIG. 2 is a front side perspective view showing the appearance of the image forming apparatus when a right side cover is removed.

FIG. 1 is a front side perspective view showing an appearance of the image forming apparatus according to the first embodiment of the present disclosure. FIG. 2 is a front side perspective view showing the appearance of the image forming apparatus when a right side cover is removed.

The image forming apparatus 1 is a multifunction peripheral having a plurality of functions, such as copying, printing, scanning, and facsimile transmission, and includes an apparatus body 11 having a document reading section 5, an image forming section 12, a paper supply section 14, a fixing section 13, a discharge tray 151, and an operation section 47.

The document reading section 5 is configured to read an image from a source document placed on platen glass (not illustrated). The image forming section 12 forms a toner image on a recording sheet based on the image data obtained through the reading by the document reading section 5. The paper supply section 14 picks up a recording sheet stored in a feeding cassette.

The fixing section 13 is arranged at an inner side of a right side cover 21, and is configured to heat the toner image on the recording sheet and fix the toner image by thermal compression onto the recording sheet. The fixing section 13 is also arranged at the apparatus body 11 so that the longitudinal direction thereof (a direction orthogonal with a conveyance direction of the recording sheet) directs from a front to a back of the apparatus body 11. The discharge tray 151 is arranged at a body of the apparatus body 11, and loads the recording sheets discharged from the apparatus body 11.

The operation section 47 receives user's instructions to execute the image forming operation, document reading operation, and so forth, with respect to operations and processes that the image forming apparatus 1 is configured to perform. The operation section 47 includes a display section 473 for displaying operation guides for the user. The display section 473 is constituted of a touch panel and an operator can operate the image forming apparatus 1 by touching buttons or keys displayed on the display section 473.

Figure 3:
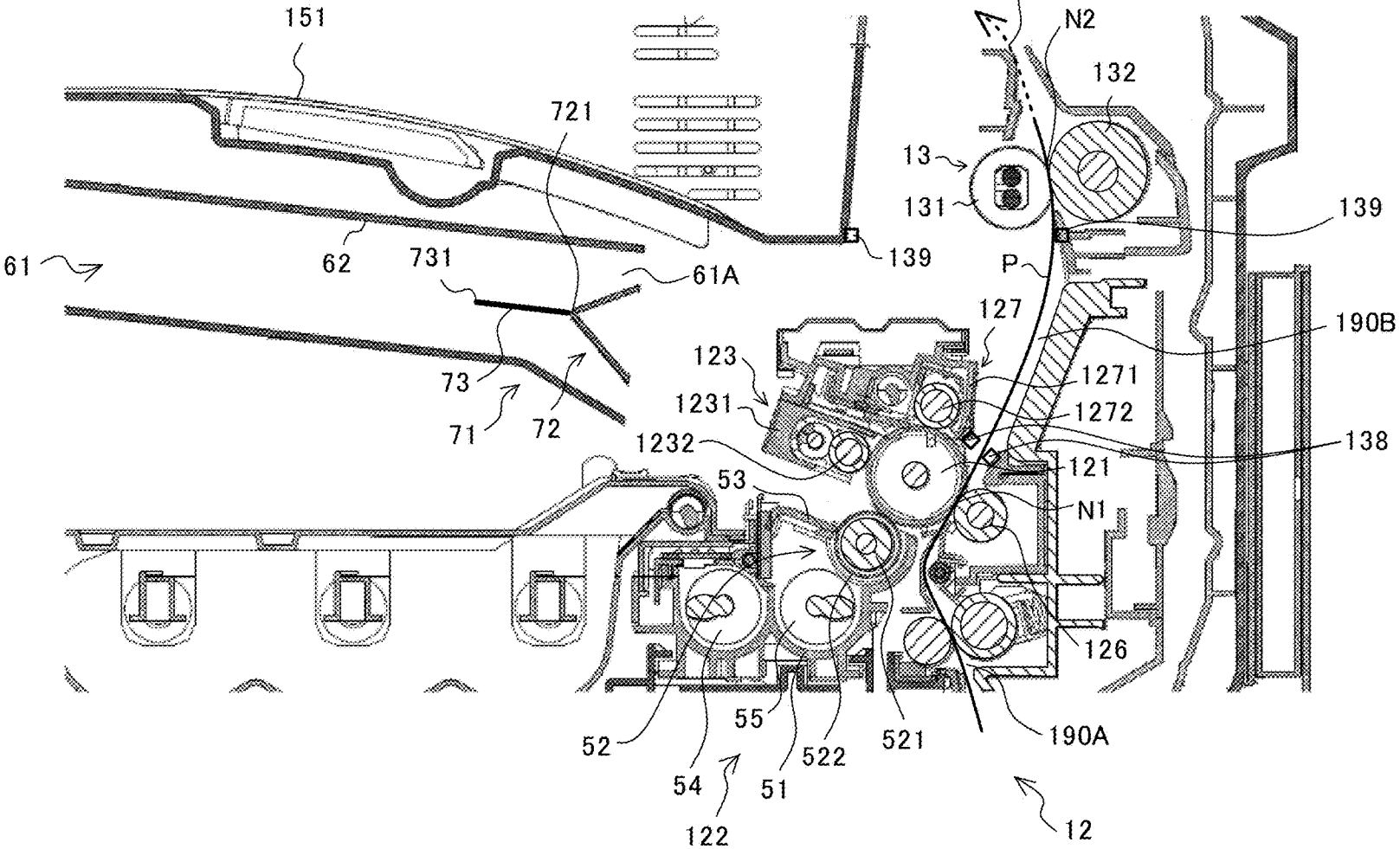
FIG. 3 is a front cross-sectional view showing an image forming section, a fixing section, and peripheral parts thereof.

FIG. 3 is a front cross-sectional view showing the image forming section 12, the fixing section 13, and peripheral parts thereof. The fixing section 13 includes a thermal roller 131 and a compression roller 132, and a recording sheet P passing through a space between the thermal roller 131 and the compression roller 132 is discharged to the discharge tray 151 by a recording sheet discharging port (not illustrated). An arrow A1 indicated by a broken line shows the conveyance direction of the recording sheet P.

The image forming section 12 includes a drum type photoreceptor 121, which is an image carrier, a charging section 123 that performs an image generation process, a developing device 122, a transfer roller 126, and a cleaning section 127. The photoreceptor 121 rotates in a counterclockwise direction in drawings about a rotation axis.

The charging section 123 includes, within a charging housing 1231, a charging roller 1232 that comes in contact with a peripheral surface of the photoreceptor 121 and charges the peripheral surface. The charging section 123 is arranged at a position opposing to the peripheral surface of the photoreceptor 121.

The developing device 122 supplies a toner to a latent image formed on the peripheral surface of the photoreceptor 121 to thereby form the toner image. A two-component developer containing the toner and a magnetic carrier is stored in a developing housing 51. The developing device 122 includes, within the developing housing 51, a developing roller 52 that comes in contact with the peripheral surface of the photoreceptor 121, a regulating blade 53 that regulates a layer thickness of the developer on the developing roller 52, and spiral feeders 54, 55 that stir and convey the developer including the toner. The developing device 122 is arranged at a position opposing to the peripheral surface of the photoreceptor 121.

The developing roller 52 includes a magnet roller 521 having a magnetic pole and a developing sleeve 522 being sheathed around the magnet roller 521. The developing sleeve 522 rotates in a clockwise direction in the drawings about the rotation axis.

The spiral feeders 54, 55 rotate and convey the developer stored in the developing housing 51 to the developing roller 52, and supply the developer to a peripheral surface of the developing roller 52. The developer having been supplied to the peripheral surface of the developing roller 52 is carried on the peripheral surface of the developing roller 52 by magnetic force of the magnet roller 521. The rotation of the developing roller 52 (the developing sleeve 522) conveys the developer to the direction of its rotation.

The transfer roller 126 is arranged so as to come in contact with the peripheral surface of the photoreceptor 121 at a downstream side of the developing device 122 with respect to the rotation direction of the photoreceptor 121. The transfer roller 126 transfers, at a transfer nip part N1 formed therebetween with the photoreceptor 121, the toner image formed on the peripheral surface of the photoreceptor 121 to the recording sheet P being conveyed through a first conveyance path 190A.

The recording sheet P, on which the toner image has been transferred at the transfer nip part N1, is conveyed through a second conveyance path 190B that is provided between the transfer roller 126 and the fixing section 13. Then, the recording sheet P is conveyed to a fixing nip part N2 formed between the thermal roller 131 and the compression roller 132. The transfer roller 126 and the second conveyance path 190B respectively exemplify the transfer section and the conveyance path in claims.

The cleaning section 127 removes the toner not being transferred onto the recording sheet P and remained on the peripheral surface of the photoreceptor 121, and includes a cleaning roller 1272 supported by a cleaning housing 1271. The cleaning section 127 is arranged at a position opposing to the peripheral surface of the photoreceptor 121.

An air path 61 guides air taken from an outside of the apparatus body 11 (FIG. 1) to the second conveyance path 190B and the developing device 122. At an outlet port 61A being one end of the air path 61, an adjustment member 71 is arranged. The adjustment member 71 includes: a branch part 72 by which the air flowing through the air path 61 is branched into a direction toward the second conveyance path 190B and a direction toward the developing device 122; and an adjustment valve 73 that adjusts volume of the air that are flowing toward each of the directions.

The branch part 72 extends to the longitudinal direction of the fixing section 13, the direction of which is orthogonal with the conveyance direction of the recording sheet P, and has a V-shaped sectional-shape in which a branching point 721 is the apex. The adjustment valve 73 is configured as rotatable about the branching point 721. Additionally, the adjustment valve 73 is configured so that a tip 731 of the adjustment valve 73 comes in contact with an upper surface 62 of an inner wall of the air path 61 when the adjustment valve 73 rotates about the branching point 721 in a clockwise direction in the drawings. The upper surface 62 of the inner wall is the inner wall in the second conveyance path 190B side at which the fixing section 13 is arranged.

Arranged at an un-illustrated intake part, which is the other end of the air path 61 and is for taking air from the outside of the apparatus body 11, is a fan (not illustrated) that takes the air from the outside of the apparatus body 11 into the air path 61 and sends out the taken-in air to the direction toward the outlet port 61A (i.e., the direction toward the second conveyance path 190B and the developing device 122).

Figure 4A:
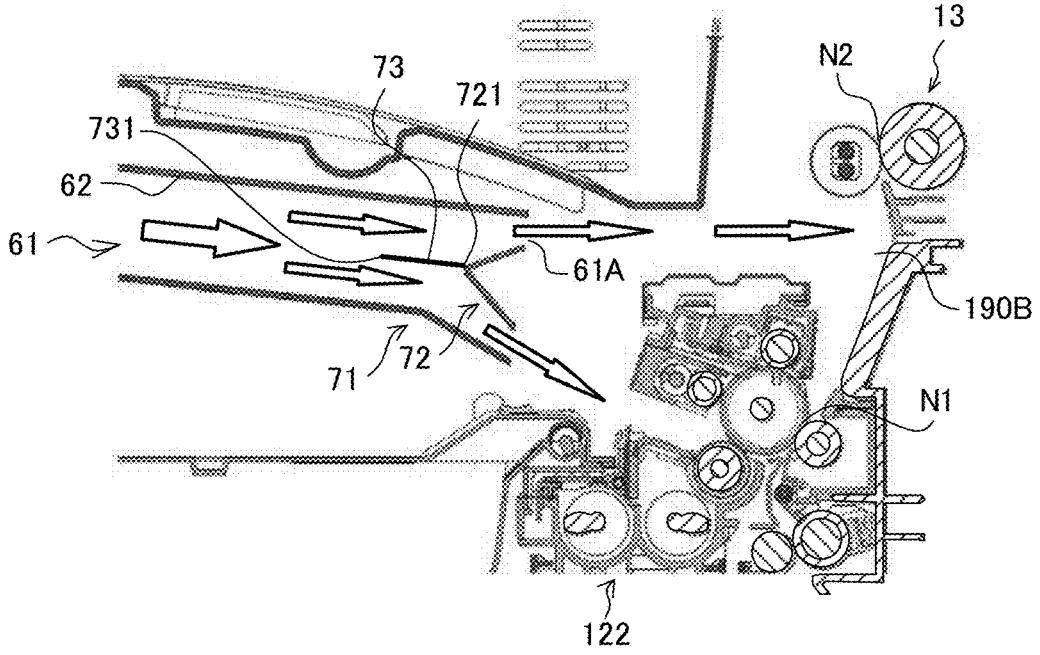
FIG. 4A and FIG. 4B are front cross-sectional views showing an outlet port of an air path and peripheral parts thereof.
Figure 4B:
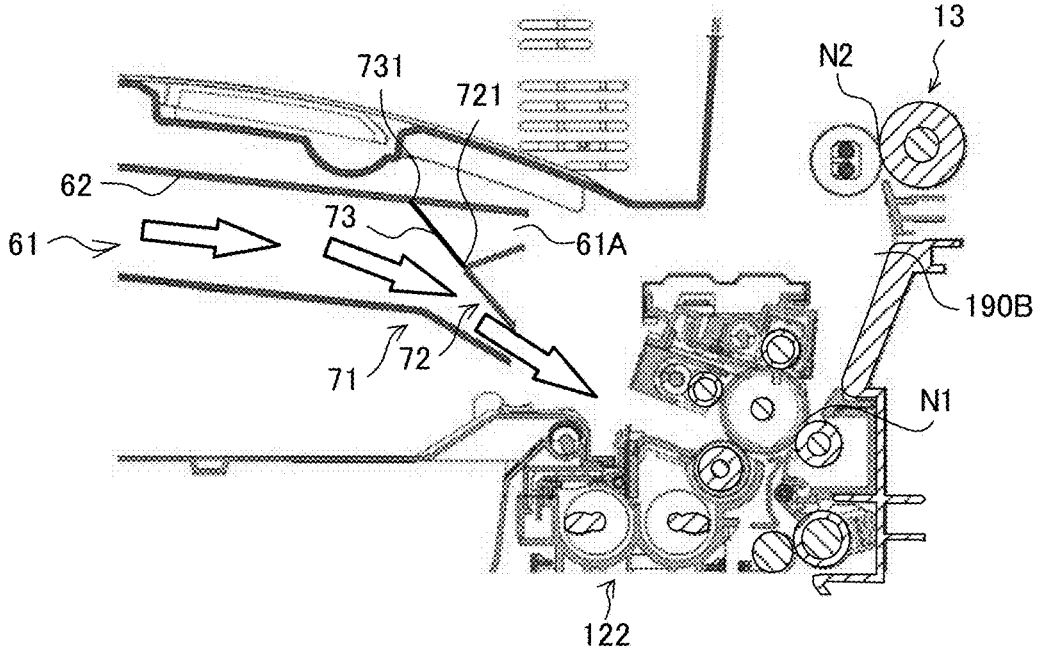

FIG. 4A and FIG. 4B are front cross-sectional views showing the outlet port 61A of the air path 61 and the peripheral parts thereof. FIG. 4A shows a state where the adjustment valve 73 is being parallel to the upper surface 62 of the inner wall of the air path 61, and FIG. 4B shows a state where the tip 731 of the adjustment valve 73 coming in contact with the upper surface 62 of the inner wall of the air path 61. Each arrow illustrated in the drawings represents an air flow.

When the adjustment valve 73 is parallel to the upper surface 62 of the inner wall of the air path 61 as shown in FIG. 4A, the air flowing through the air path 61 is branched into the direction toward the second conveyance path 190B and the direction toward the developing device 122.

On the other hand, when the tip 731 of the adjustment valve 73 is in contact with the upper surface 62 of the inner wall of the air path 61 as shown in FIG. 4B, the flow of the air flowing into the second conveyance path 190B is blocked, so that the volume of the air flowing into the developing device 122 increases.

FIG. 3 illustrates that at a position being a downstream side from the transfer nip part N1 in the conveyance direction of the recording sheet P and being immediately after the transfer nip part N1, a first paper sheet sensor 138 is provided. The first paper sheet sensor 138 includes a light emitting part and a light receiving part. The light emitting part and the light receiving part are respectively disposed at one side and the other side opposed to each other across the position where the recording sheet P passes through in the second conveyance path 190B.

At a position being an upstream side from the fixing nip part N2 in the conveyance direction of the recording sheet P and being immediately before the fixing nip part N2, a second paper sheet sensor 139 is provided. Like the first paper sheet sensor 138, the second paper sheet sensor 139 also includes a light emitting part and a light receiving part. The light emitting part and the light receiving part are respectively disposed at one side and the other side opposed to each other across the position where the recording sheet P passes through in the second conveyance path 190B.

When the recording sheet P is not passing between the light emitting parts and the light receiving parts of the first paper sheet sensor 138 and the second paper sheet sensor 139, the light receiving parts of both of the first paper sheet sensor 138 and the second paper sheet sensor 139 respectively receive the light emitted from the light emitting parts and output an on-signal (paper sheet absence signal) to a control section 100 (mentioned later). When the recording sheet P is passing between the light emitting parts and the light receiving parts of the first paper sheet sensor 138 and the second paper sheet sensor 139, the light receiving parts of both of the first paper sheet sensor 138 and the second paper sheet sensor 139 output an off-signal (paper sheet presence signal) to the control section 100 without receiving the light emitted from the light emitting parts.

Figure 5:
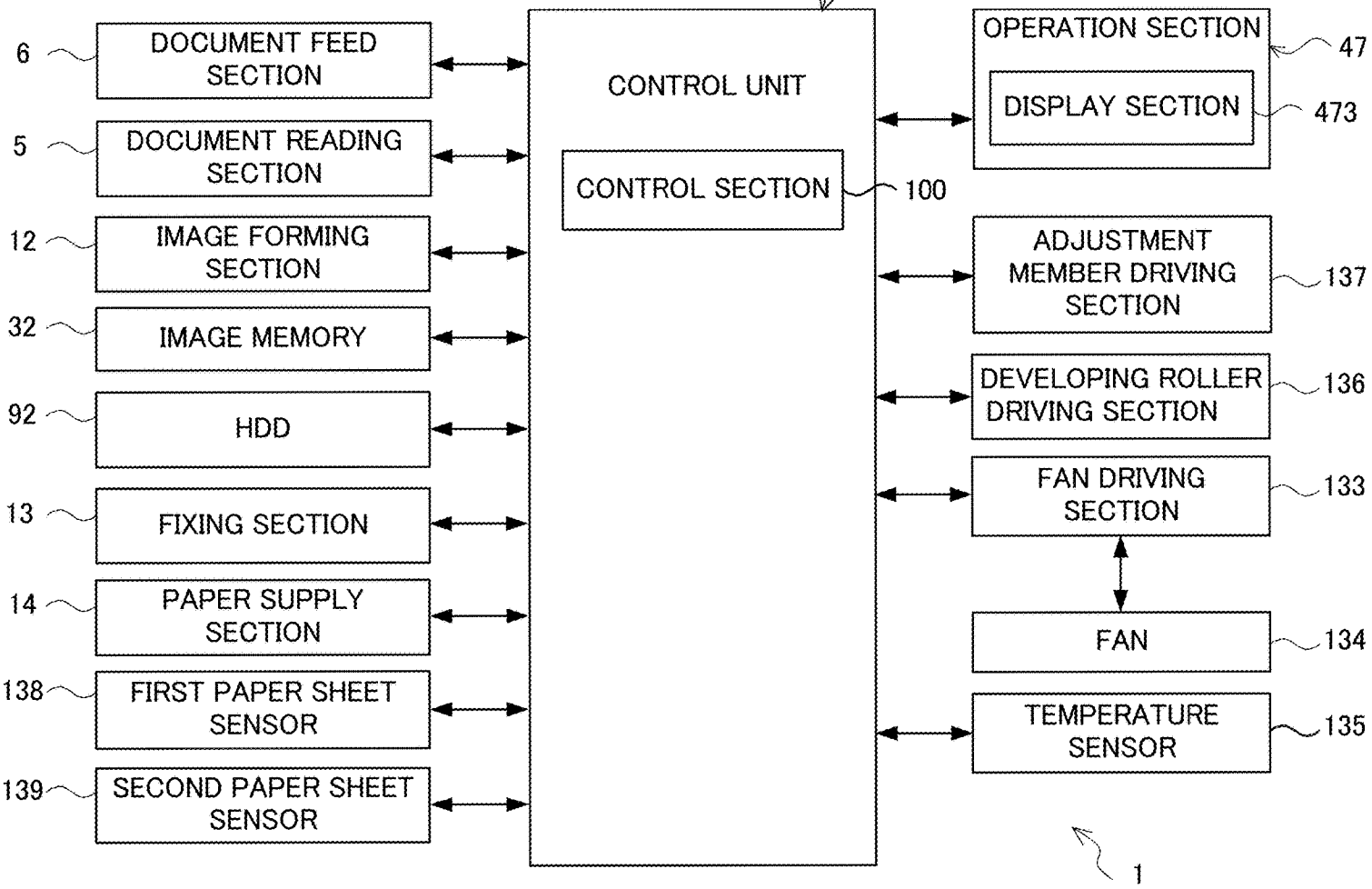
FIG. 5 is a functional block diagram schematically showing an essential part of an internal configuration of the image forming apparatus.

FIG. 5 is a functional block diagram schematically showing an essential part of an internal configuration of the image forming apparatus 1. The image forming apparatus 1 includes a control unit 10, a document feed section 6, the document reading section 5, the image forming section 12, an image memory 32, a hard disc drive (HDD) 92, the fixing section 13, the paper supply section 14, the operation section 47, an adjustment member driving section 137, a developing roller driving section 136, a fan driving section 133, a fan 134, and a temperature sensor 135. The constituents same as the image forming apparatus 1 described above with reference to FIG. 1 to FIG. 4B are given the same numerals, and the detailed descriptions thereof will not be repeated here.

The document feed section 6 feeds a document to be read to the document reading section 5. Under the control of the control section 100 constituting the control unit 10, the document reading section 5 illuminates the document with a light emitting section and receives the reflected light to thereby read the an image from the document. The image data acquired by the document reading section 5 is to be stored on the image memory 32.

The image memory 32 is a region for temporarily storing the image data of the document acquired by the document reading section 5 and data to be printed by the image forming section 12. The HDD 92 is a large-capacity storage device for storing the image data of the document acquired by the document reading section 5 and so forth.

The adjustment member driving section 137 is formed with a motor, a gear, a driver, and so on, and serves as a drive source that provides a rotational driving force to the adjustment valve 73 constituting the adjustment member 71.

The developing roller driving section 136 is formed with a motor, a gear, a driver, and so on, and serves as a drive source that provides a rotational driving force to the developing sleeve 522 constituting the developing roller 52.

The fan driving section 133 is a driver, a motor, and so on, and drives the fan 134. Under the control of the control section 100, the fan driving section 133 makes adjustments, for example, on wind velocity of the fan 134. The fan 134 takes in the air from the outside of the apparatus body 11 (FIG. 1) into the air path 61, and takes out the taken air to the direction toward the outlet port 61A (FIG. 3).

The temperature sensor 135 is provided at the inside of the apparatus body 11, and detects an internal temperature of the apparatus body 11.

The control unit 10 includes a processor, a random access memory (RAM), a read only memory (ROM), and an exclusive hardware circuit. The processor is, for example, a central processing unit (CPU), an application specific integrated circuit (ASIC), and a micro processing unit (MPU). The control unit 10 includes the control section 100.

The control unit 10 acts as the control section 100 when the processor operates in accordance with a control program stored in the HDD 92. However, the control section 100 may be constituted of hardware circuits instead of the operation by the control unit 10 in accordance with the control program. This also applies to other embodiments, unless otherwise specifically noted.

The control section 100 governs the control of the overall operation of the image forming apparatus 1. The control section 100 is connected to the document feed section 6, the document reading section 5, the image forming section 12, the image memory 32, the HDD 92, the fixing section 13, the paper supply section 14, the operation section 47, the adjustment member driving section 137, the developing roller driving section 136, the fan driving section 133, and the temperature sensor 135, and controls driving of each of the sections. For example, the control section 100 controls the conveyance of the recording sheet P. Accordingly, the control section 100 is capable of recognizing conveyance status of the recording sheet P (i.e., positions of a leading end and a rear end of the recording sheet P). The temperature sensor 135 detects a temperature around where the developing is performed.

Additionally, when the control section 100 determines, based on temperature information obtained from the temperature sensor 135, that the internal temperature of the apparatus body 11 has become equal to or over a predetermined temperature T1, such as 40° C. (degrees Celsius), the control section 100 temporarily stops the image forming operation and sets on the cooling mode in which at least the developing device 122 is cooled. When the control section 100 determines that the internal temperature of the apparatus body 11 has become equal to or lower than a predetermined temperature T2, such as 38° C. (T2<T1), or determines that a fixed time period M1 has elapsed after setting the cooling mode on, the control section 100 releases the cooling mode.

Furthermore, the control section 100 controls the driving of the first paper sheet sensor 138 and the second paper sheet sensor 139. The control section 100 determines, based on the signals outputted from the first paper sheet sensor 138 and the second paper sheet sensor 139, whether the leading end and the rear end of the recording sheet P are present in the second conveyance path 190B. The determination is performed as follows.

When the off-signal (the paper sheet presence signal) is being outputted from the first paper sheet sensor 138 and the on-signal (the paper sheet absence signal) is being outputted from the second paper sheet sensor 139, the control section 100 determines that in the second conveyance path 190B, the leading end of the recording sheet P exists at a position further downstream than the transfer nip part N1 in the conveyance direction of the recording sheet P and further upstream than the fixing nip part N2 in the conveyance direction of the recording sheet P.

Under a condition in which the signal being outputted from the first paper sheet sensor 138 is switched from the off-signal (the paper sheet presence signal) to the on-signal (the paper sheet absence signal) and the off-signal (the paper sheet presence signal) is being outputted from the second paper sheet sensor 139, the control section 100 determines that in the second conveyance path 190B, the rear end of the recording sheet P exists at a position further downstream than the transfer nip part N1 in the conveyance direction of the recording sheet P and further upstream than the fixing nip part N2 in the conveyance direction of the recording sheet P. Following the just-mentioned determination, when the on-signal (the paper sheet absence signal) is outputted from the first paper sheet sensor 138 and the signal being outputted from the second paper sheet sensor 139 is switched from the off-signal (the paper sheet presence signal) to the on-signal (the paper sheet absence signal), the control section 100 determines that the rear end of the recording sheet P does not exist in the second conveyance path 190B.

Figure 6:
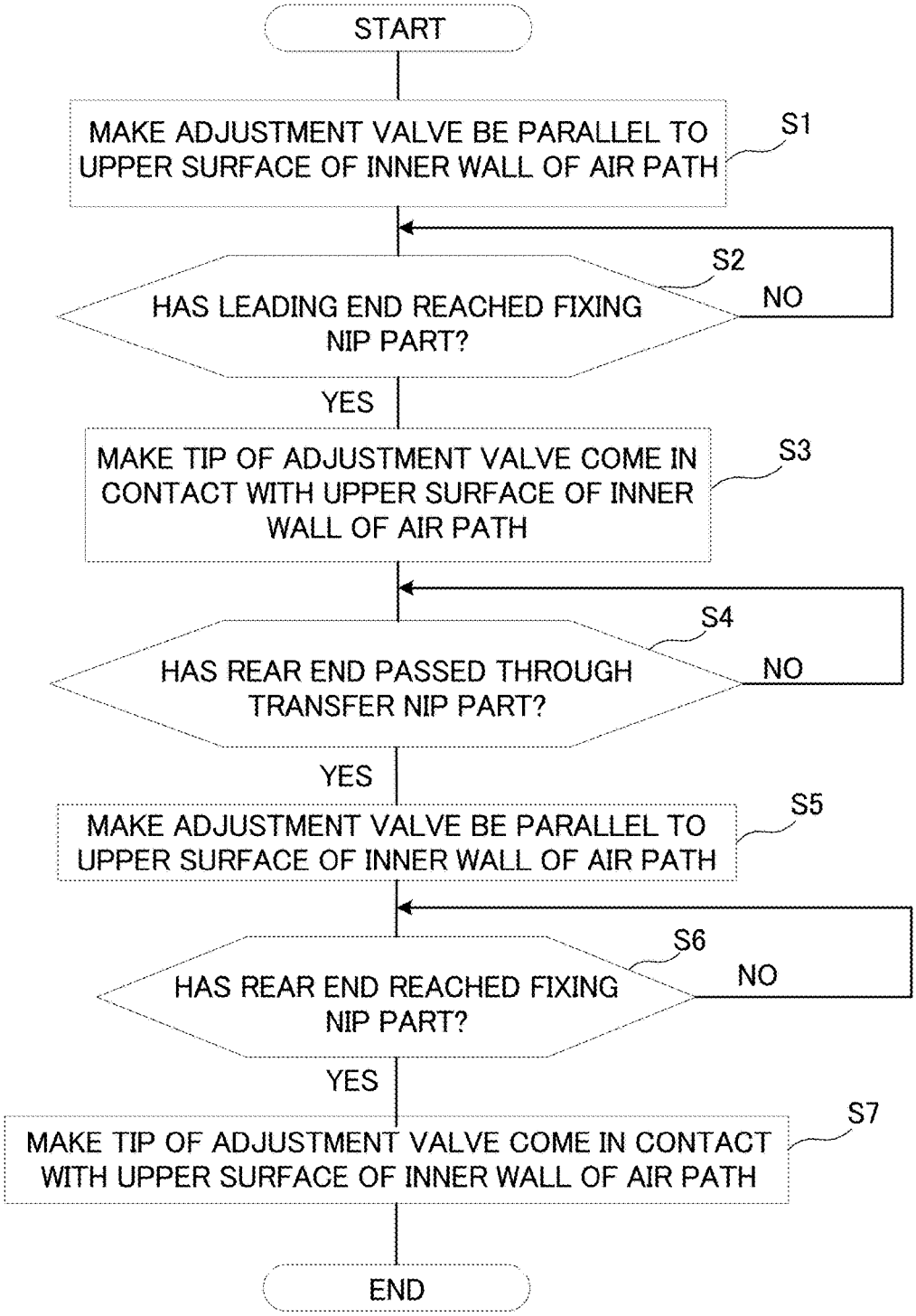
FIG. 6 is a flowchart showing an example of processing operation performed at a control unit of the image forming apparatus according to the first embodiment.

The descriptions will be given next for an example of processing operation performed at the control unit 10 with reference to a flowchart illustrated in FIG. 6. The processing operation is performed when the control section 100 determines that the leading end of the recording sheet P has passed through the transfer nip part N1.

Figure 7A:
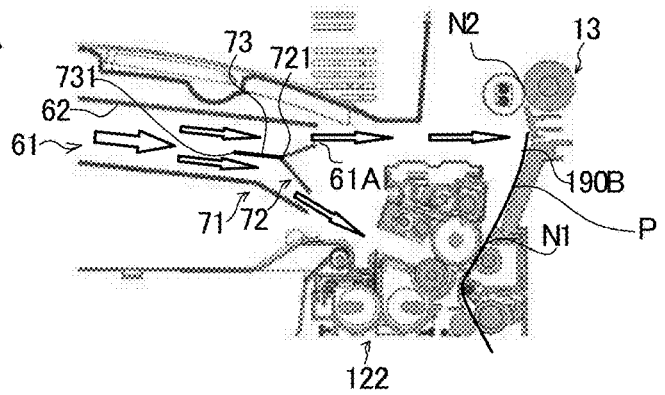
FIG. 7D is a front cross-sectional view for explaining a relation between a position of the recording sheet and a state of the adjustment valve.

Upon determination that the leading end of the recording sheet P has passed through the transfer nip part N1, the control section 100 rotates the adjustment valve 73 by controlling the adjustment member driving section 137, to thereby cause the adjustment valve 73 to be in a position parallel to the upper surface 62 of the inner wall of the air path 61 (S1). FIG. 7A illustrates the condition of the adjustment valve 73 and the position of the recording sheet P under the above-mentioned situation.

Figure 7B:
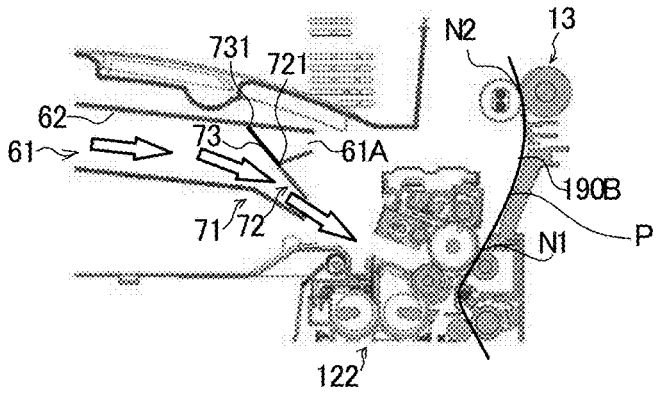

The control section 100 then determines whether the leading end of the recording sheet P has reached the fixing nip part N2 (S2). Upon determination that the leading end of the recording sheet P has reached the fixing nip part N2 (YES in S2), the control section 100 controls the adjustment member driving section 137 and rotates the adjustment valve 73, to thereby cause the tip 731 of the adjustment valve 73 to come in contact with the upper surface 62 of the inner wall of the air path 61 (S3). FIG. 7B illustrates the condition of the adjustment valve 73 and the position of the recording sheet P under the above-mentioned situation.

Figure 7C:
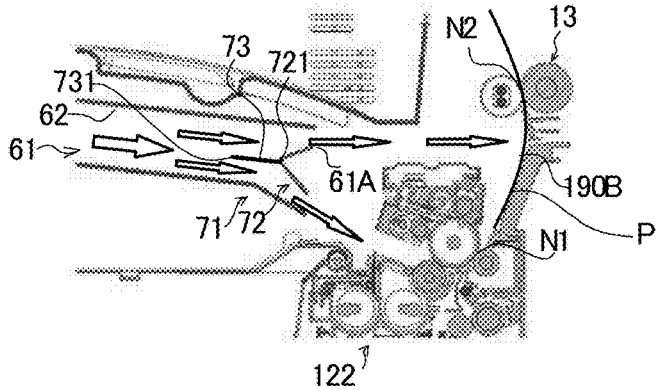

Subsequently, the control section 100 determines whether the rear end of the recording sheet P has passed through the transfer nip part N1 (S4), and upon determination that the rear end of the recording sheet P has passed through the transfer nip part N1 (YES in S4), the control section 100 controls the adjustment member driving section 137 and rotates the adjustment valve 73, to thereby cause the adjustment valve 73 to be in the position parallel to the upper surface 62 of the inner wall of the air path 61 (S5). FIG. 7C illustrates the condition of the adjustment valve 73 and the position of the recording sheet P under the above-mentioned situation.

Figure 7D:
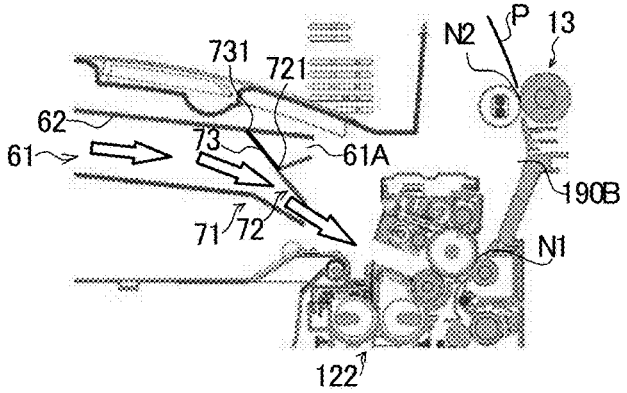

The control section 100 then determines whether the rear end of the recording sheet P has reached the fixing nip part N2 (S6). Upon determination that the rear end of the recording sheet P has reached the fixing nip part N2 (YES in S6), the control section 100 controls the adjustment member driving section 137 and rotates the adjustment valve 73, to thereby cause the tip 731 of the adjustment valve 73 to come in contact with the upper surface 62 of the inner wall of the air path 61 (S7). The processing ends afterwards. FIG. 7D illustrates the condition of the adjustment valve 73 and the position of the recording sheet P under the above-mentioned situation.

With the processing described above, when there is no recording sheet P in the second conveyance path 190B, the tip 731 of the adjustment valve 73 comes in contact with the upper surface 62 of the inner wall of the air path 61 as shown in FIG. 7D, so that the flow of the air flowing toward the second conveyance path 190B is blocked. Accordingly, the volume of the air flowing into the developing device 122 can be increased.

As shown in FIG. 7B, even if the recording sheet P exists in the second conveyance path 190B, when the recording sheet P is caught in both the transfer nip part N1 and the fixing nip part N2, and behavior of the recording sheet P in the second conveyance path 190B is stable, the tip 731 of the adjustment valve 73 still comes in contact with the upper surface 62 of the inner wall of the air path 61, so that the air is not sent toward the second conveyance path 190B. Accordingly, the volume of the air flowing into the developing device 122 can be increased.

Figure 8:
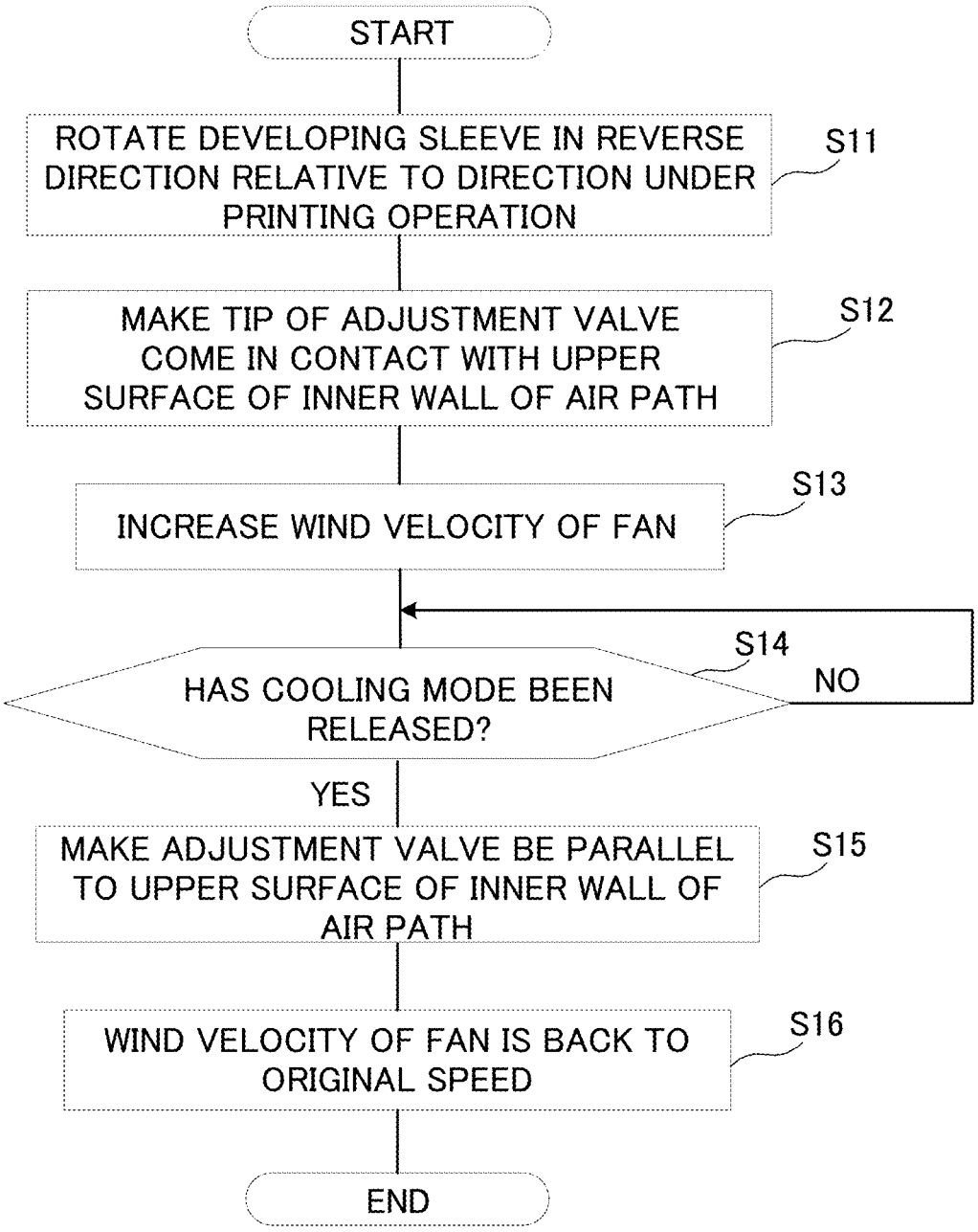
FIG. 8 is a flowchart showing an example of processing operation performed at the control unit of the image forming apparatus according to the first embodiment.

The descriptions will be given next for an example of processing operation performed at the control unit 10 with reference to a flowchart illustrated in FIG. 8. The processing operation is performed when the image forming apparatus 1 is operated under the cooling mode by the control section 100.

In operating the image forming apparatus 1 under the cooling mode, the control section 100 controls the developing roller driving section 136 and rotates the developing sleeve 522 in the reverse direction relative to the direction under the image forming operation performed by the photoreceptor 121, the developing device 122, the transfer roller 126, and the fixing section 13; the aforesaid rotation is made for about 90 degrees, for example (S11). Also, the control section 100 controls the adjustment member driving section 137 and rotates the adjustment valve 73 and, as shown in FIG. 7B, causes the tip 731 of the adjustment valve 73 to come in contact with the upper surface 62 of the inner wall of the air path 61 (S12), and then, controls the fan driving section 133 and the wind velocity of the fan 134 becomes higher than that of under the image forming operation (S13).

Figure 9A:
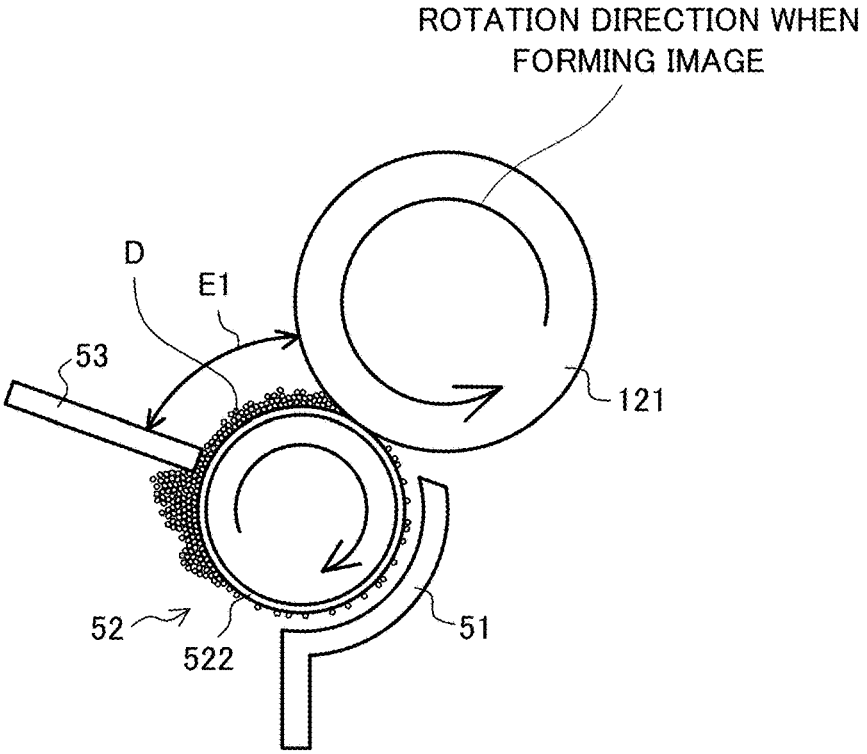
FIG. 9A and FIG. 9B are front cross-sectional views showing developing roller and peripheral parts thereof.
Figure 9B:
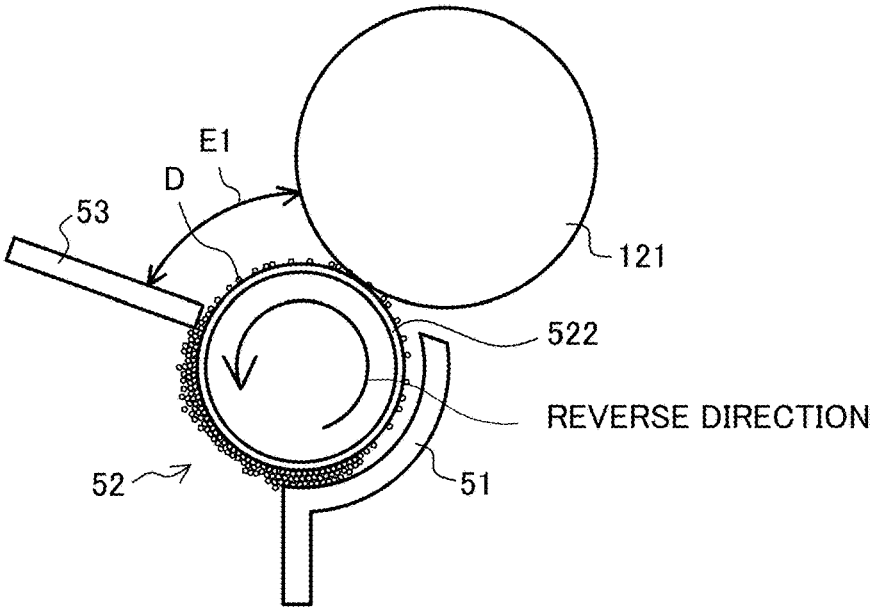

FIG. 9A and FIG. 9B are front cross-sectional views showing the developing roller 52 and peripheral parts thereof. FIG. 9A shows a state before the developing sleeve 522 is rotated in the reverse direction and FIG. 9B shows a state after the developing sleeve 522 has been rotated in the reverse direction. Arrows illustrated on the photoreceptor 121 and the developing sleeve 522 in FIG. 9A represent rotation directions under the image forming operation. The developing sleeve 522 rotates in the clockwise direction under the image forming operation.

As shown in FIG. 9A, the amount of the developer D carried on the developing roller 52 is larger in an area E1 (i.e., an upstream side in the rotation direction of the photoreceptor 121 under the image forming operation) to which the air from the air path 61 is blown than a downstream side in the rotation direction. As shown in FIG. 9B, by rotating the developing sleeve 522 for about 90 degrees in the reverse direction relative to the direction under the image forming operation, the amount of the developer D carried on the developing roller 52 in the area E1 can be decreased.

The control section 100 releases the cooling mode and determines whether the cooling mode has been released (S14). Upon determination that the cooling mode has been released (YES in S14), the control section 100 controls the adjustment member driving section 137 and rotates the adjustment valve 73, as shown in FIG. 7C, to thereby cause the adjustment valve 73 to be in the position parallel to the upper surface 62 of the inner wall of the air path 61 (S15), and controls the fan driving section 133 so that the wind velocity of the fan 134 is back to the original velocity (S16). The processing ends afterwards.

The above-described first embodiment includes the air path 61 for guiding the air taken from the outside of the apparatus body 11 to the second conveyance path 190B and the developing device 122, and thus can prevent the recording sheet P from being raised from the second conveyance path 190B and can properly convey the recording sheet P to the fixing section 13. In addition, because the first embodiment can blow the wind to the developing device 122, a temperature rise in the developing device 122 can be suppressed.

Furthermore, when there is no recording sheet P in the second conveyance path 190B, the operation of the adjustment member 71 is controlled so that the air flowing through the air path 61 heads toward the developing device 122 (does not head toward the second conveyance path 190B). Thus, when there is no recording sheet P in the second conveyance path 190B (i.e., when it is not necessary to blow air to the second conveyance path 190B), the first embodiment can intensively blow the air taken from the outside of the apparatus body 11 to the developing device 122. Accordingly, the temperature rise in the developing device 122 can be efficiently suppressed.

An internal temperature of an apparatus easily rises when performing a large amount printing such as a consecutive printing. If a cooling mode is executed and the printing operation is interrupted during the large amount printing only because the temperature is raised, the printing-operation time is extended and a printing efficiency is deteriorated. This will give stress to a user. In order to solve such the problem, improving cooling efficiency of developing device and reducing cooling mode time to the upmost are desired.

The image forming apparatus in this disclosure is capable of improving the cooling efficiency of developing device, thereby shortening the cooling mode time.

Because the amount of the developer D carried on the developing roller 52, which is influenced by the air from the air path 61, is smaller under the cooling mode than the image forming operation, the air from the air path 61 can be blown directly to the developing roller 52, and cooling efficiency of the developing roller 52 is enhanced. The enhanced cooling efficiency of the developing device 122 can shorten the time for the cooling mode. Toner scattering caused by the air blown can be reduced because the amount of the developer D carried on the developing roller 52 under the cooling mode is small, as described above.

An image forming apparatus according to another embodiment may include a regulating blade driving section formed with a motor, a gear, a driver, and so forth. In the image forming apparatus, the regulating blade 53 regulates thickness of the developer D carried on the developing roller 52, and the control section 100 may be designed to control the regulating blade driving section to thereby rotate (or move to the photoreceptor 121 side) the regulating blade 53 (not the developing sleeve 522) in the clockwise direction in FIG. 9A (i.e., the rotation direction same as the developing roller 52). The amount of the developer D carried on the developing roller 52 may be able to be minimized in such the manner.

In an image forming apparatus according to still another embodiment, with respect to the regulating blade 53, for example, a length in the width direction of both end portions in the rotation axis direction of the developing roller 52 (the direction from the regulating blade 53 to a surface of the developing roller 52) is arranged to be longer than a center portion of the rotation axis direction. Also, a distance from the end portion of the regulating blade 53 at the developing roller 52 side in the width direction to the surface of the developing roller 52 may be arranged to be shorter than that from the center portion. With the arrangement above, the amount of the developer D on the surface of the developing roller 52 on the both end portions may be made to be smaller than that on the center portion.

Figure 10A:
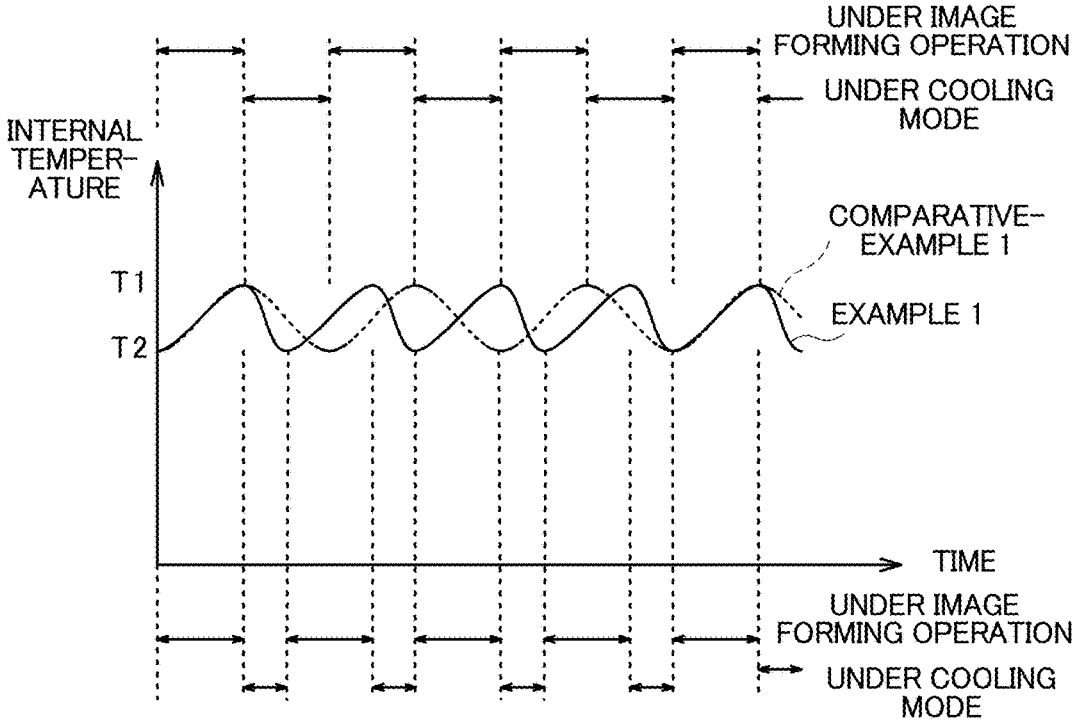
FIG. 10A and FIG. 10B are graphs showing changes in an internal temperature when image forming operation is carried out in succession.
Figure 10B:
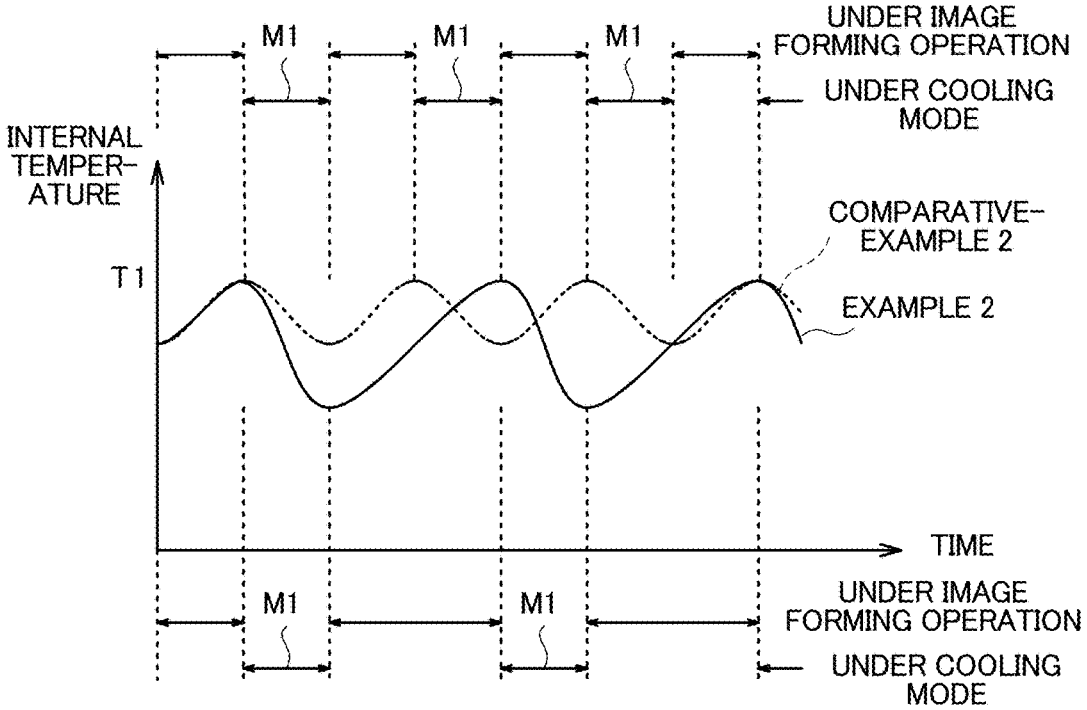

FIG. 10A and FIG. 10B are graphs showing changes in the internal temperature when image forming operation is carried out in succession. FIG. 10A shows Example 1 in which the cooling mode is released when the internal temperature becomes equals to or below the predetermined temperature T2. FIG. 10B shows Example 2 in which the cooling mode is released when the fixed time period M1 elapsed from the setting of the cooling mode.

Examples 1 and 2 are the cases when the control of reducing the amount of the developer D on the developing roller 52 that are carried in the area E1 under the cooling mode. Cases in which the just mentioned control is not performed are described in comparative examples 1 and 2.

As shown in FIG. 10A, Example 1 requires shorter time period, in which the internal-temperature drops from T1 to T2, than Comparative-example 1, so that Example 1 is capable of releasing the cooling mode quickly and improving the productivity.

As shown in FIG. 10B, during the fixed time period M1, the internal temperature is decreased greatly in Example 2 than Comparative example 2. Therefore, it takes longer in Example 2 for the internal temperature to reach T1 again, and the productivity can be improved.

The first embodiment describes the case in which the two-component developer containing the toner and a magnetic carrier is stored in the developing housing 51, and the technique of reducing the amount of the developer D on the developing roller 52 carried in the area E1 (FIG. 9A) by rotating the developing sleeve 522 in the reverse direction. The first embodiment is adaptable to the case in which one-component developer containing only the toner is stored in the developing housing 51.

Figure 18:
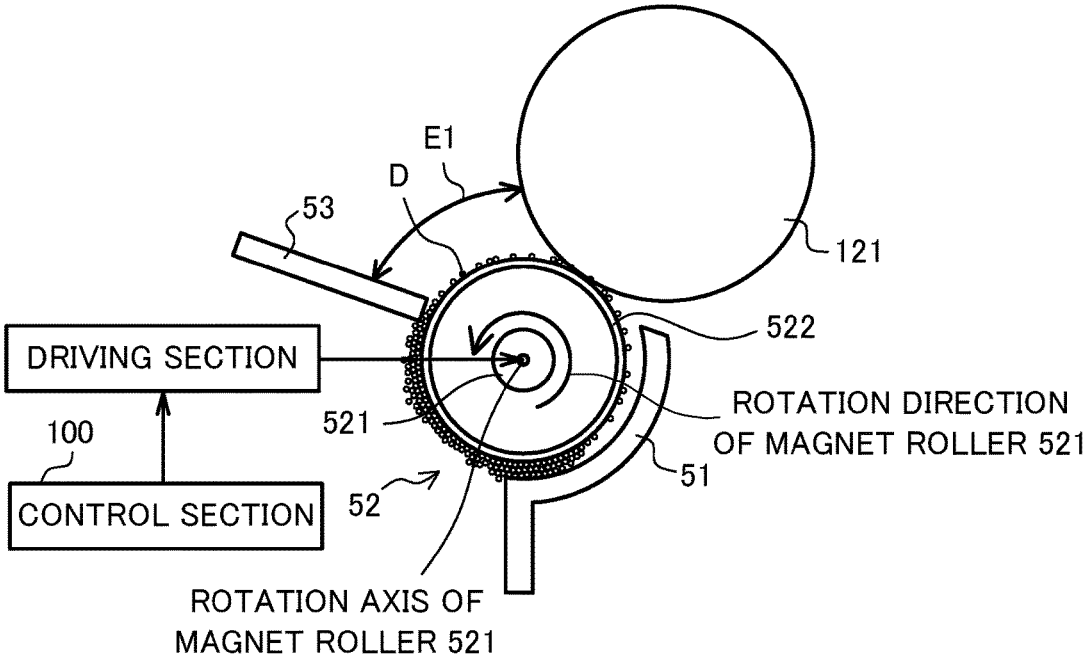
FIG. 18 is a front cross-sectional view showing the developing roller and the peripheral part thereof, and showing a state after a magnet roller is rotated.

For example, the magnet roller 521 constituting the developing roller 52 may be rotatable configured, and as illustrated in FIG. 18, the control section 100 may be designed to control a driving section having, for example, a motor connected to a rotation axis of the magnet roller 521, and rotate the magnet roller 521, and change magnetic force of the magnetic pole included in the magnet roller 521, to thereby separate the developer D from the developing roller 52. The amount of the developer D on the developing roller 52 carried on the area E1 (FIG.9A) may be reduced by this arrangement. Also, at that time, the control section 100 may be designed to cause the wind to be blown to the peripheral surface of the developing roller 52 entirely by rotating the developing roller 52 (the developing sleeve 522) in a lower speed than the speed under the image forming operation.

Figure 11A:
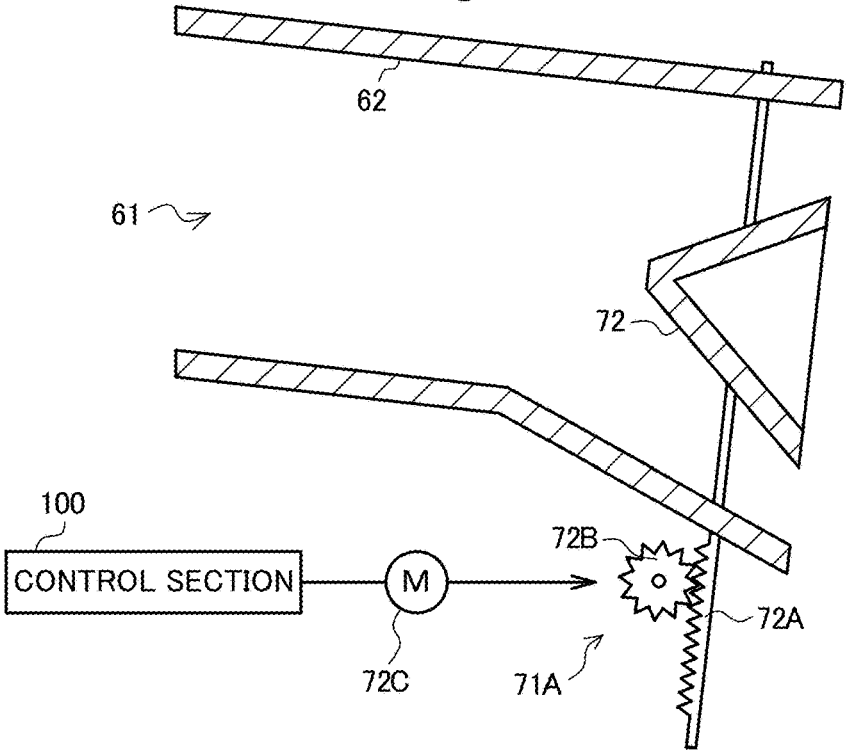
FIG. 11A and FIG. 11B are front cross-sectional views schematically showing the adjustment member of the image forming apparatus and peripheral parts thereof according to a second embodiment.
Figure 11B:
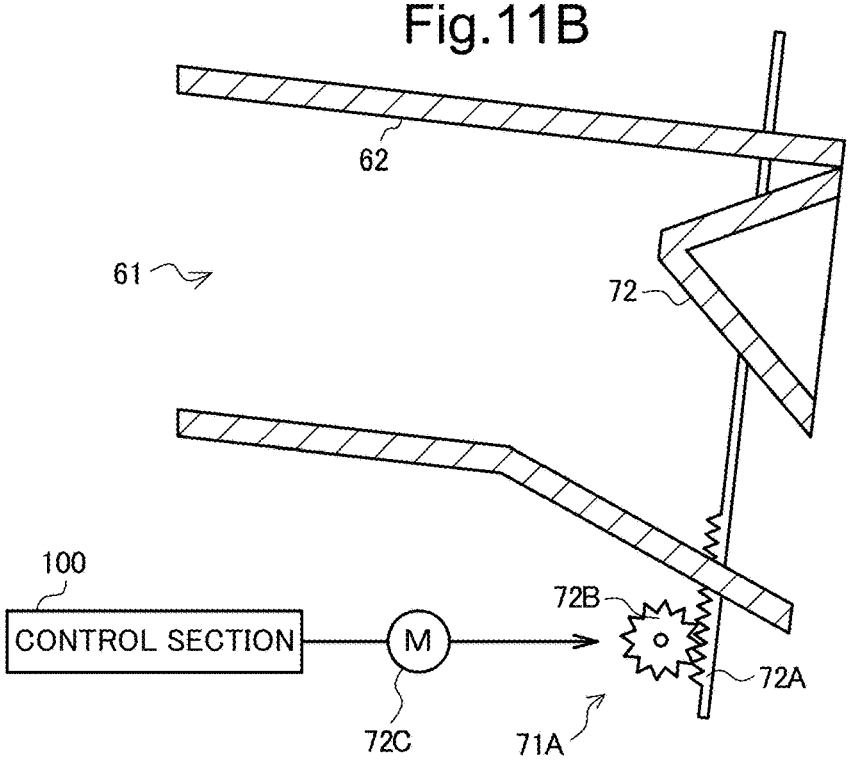

The adjustment valve 73 is used to stop the air that flows through the outlet port 61A from heading toward the second conveyance path 190B in the first embodiment. In the second embodiment, the adjustment valve 73 may be designed not to include the adjustment member 71A, as shown in FIG. 11A and FIG. 11B. Instead, the branch part 72 (constituting the adjustment member 71A) itself may be configured to be moved.

One example of a moving mechanism moving the adjustment member 71A is a rack-pinion mechanism. In the mechanism, a moving part 72A extending in the vertical direction and having a rack formed thereon is attached to the branch part 72, and the control section 100 controls driving of a motor 72C connected to a rotation axis of a pinion gear 72B that engages the rack.

As shown in FIG. 11A, when the adjustment member 71A is arranged at the center of the air path 61, the air flowing through the air path 61 is branched into the direction toward the second conveyance path 190B (upper side) and the direction toward the developing device 122 (lower side).

On the other hand, when an upper end of the adjustment member 71A is in contact with the upper surface 62 of the inner wall of the air path 61 as shown in FIG. 11B, the flow of the air flowing into the second conveyance path 190B is blocked, so that the volume of the air flowing into the developing device 122 increases.

Figure 12:
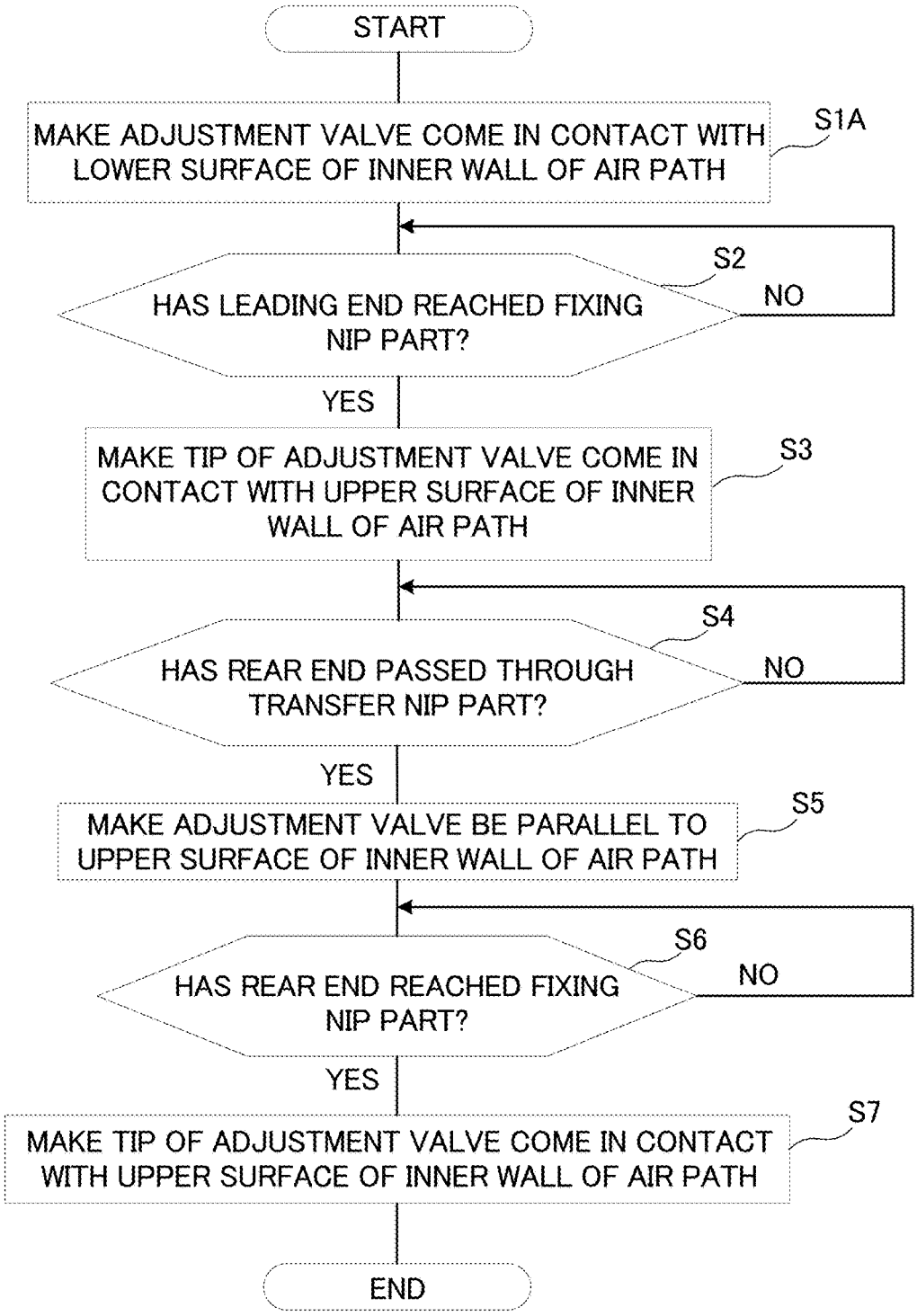
FIG. 12 is a flowchart showing an example of processing operation performed at the control unit of the image forming apparatus according to another embodiment.

FIG. 12 is a flowchart showing an example of the processing operation performed at the control unit 10 according to another embodiment. The processing operation is performed when the control section 100 controls the paper supply section 14 to thereby start paper supply of the recording sheet P. The processing operation in another embodiment (FIG. 12) is different from the processing operation in the first embodiment (FIG. 6) with respect to processing start timing and with respect to the first processing to be performed right after the start. However, the processing in S2 and all the processing following thereafter are the same.

Upon causing the paper supply section 14 to start paper supply of the recording sheet P, the control section 100 controls the adjustment member driving section 137 and rotates the adjustment valve 73, to thereby cause the tip 731 of the adjustment valve 73 to come in contact with a lower surface of the inner wall of the air path 61 (S1A).

The control section 100 then determines whether the leading end of the recording sheet P has reached the fixing nip part N2 (S2). Upon determination that the leading end of the recording sheet P has reached the fixing nip part N2 (YES in S2), the control section 100 controls the adjustment member driving section 137 and rotates the adjustment valve 73, to thereby cause the tip 731 of the adjustment valve 73 to come in contact with the upper surface 62 of the inner wall of the air path 61 (S3).

With the processing described above, from the start of the paper supply of the recording sheet P (i.e., from developing start timing) until the leading end of the recording sheet P reaches the fixing nip part N2, the air is blown only to the second conveyance path 190B and the air to be flown to the developing device 122 is blocked. Accordingly, toner scattering under the image forming operation can be prevented.

Figure 13:
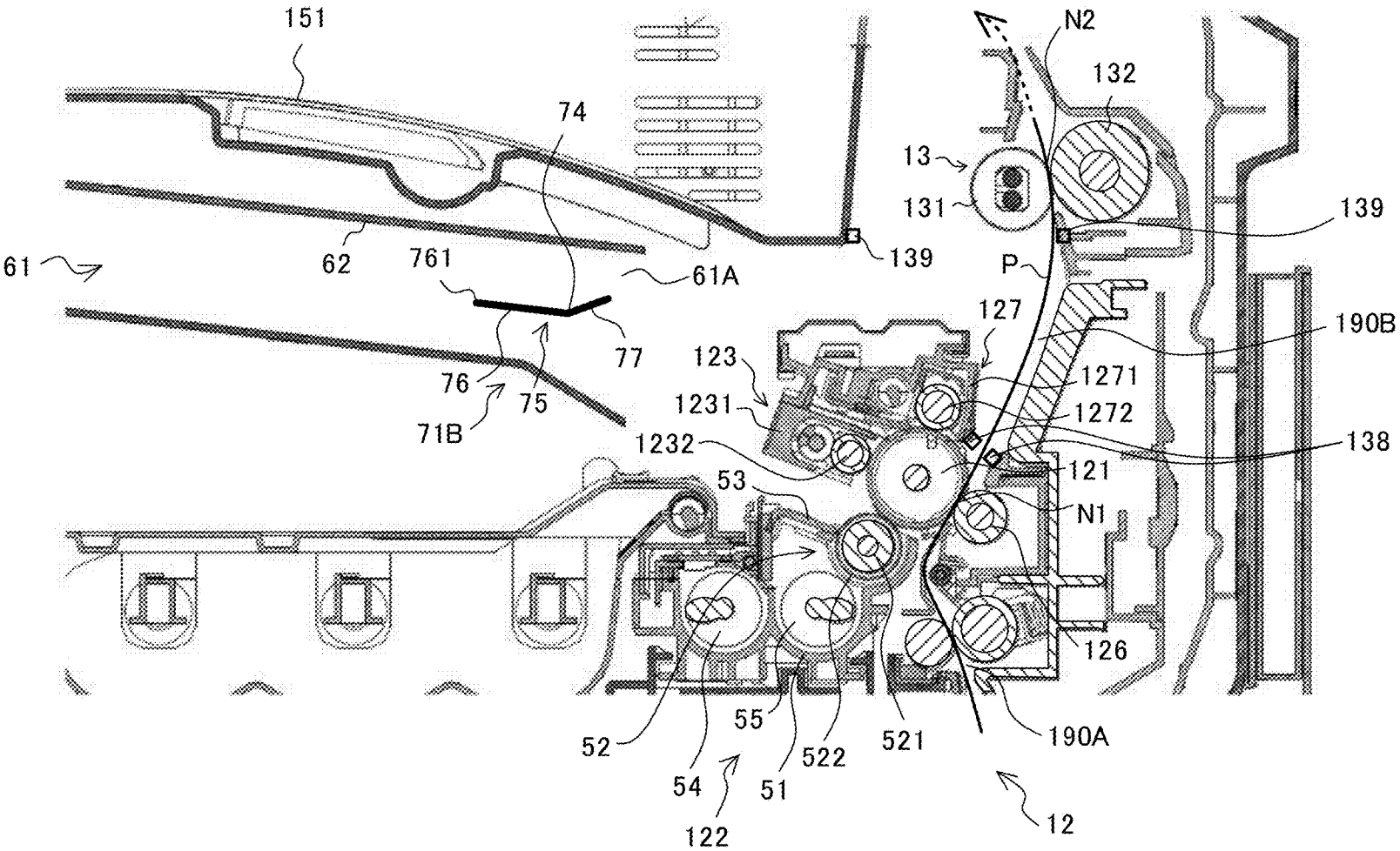
FIG. 13 is a front cross-sectional view showing the image forming section, the fixing section, and peripheral parts thereof according to a third embodiment.

FIG. 13 is a front cross-sectional view showing the image forming section 12, the fixing section 13, and the peripheral parts thereof of the image forming apparatus 1 according to the third embodiment. The third embodiment is different from the first embodiment with respect to the following points. In the third embodiment, the adjustment member 71B has a rotation axis 74 that extends toward the longitudinal direction of the fixing section 13, the direction of which is orthogonal with the conveyance direction of the recording sheet P; the adjustment valve 75 that can rotate and has a sectional-shape bendable at the rotation axis 74, the sectional-shape being formed in the L-shape; and the adjustment member driving section 137 rotatably drives the adjustment valve 75.

A first oblique side section 76 being one side at the rotation axis 74 branches the air flowing through the air path 61 into the direction toward the second conveyance path 190B and the direction toward the developing device 122, adjusts volume of the air that are flowing toward each of the directions, and by the rotation of the adjustment valve 75, a tip 761 of the first oblique side section 76 can come in contact with the upper surface 62 of the inner wall of the air path 61 (that is, a tip 761 of the first oblique side section 76 can come in contact with the inner wall at the second conveyance path 190B, which is an arrangement position side of the fixing section 13 in the air path 61), and closes an air duct directed toward the second conveyance path 190B in the air path 61 under the just-described contacting state.

A second oblique side section 77 being the other side of the rotation axis 74 extends toward the arrangement position of the fixing section 13, and is capable of adjusting directions of the air blowing toward the second conveyance path 190B from the outlet port 61A.

Figure 14A:
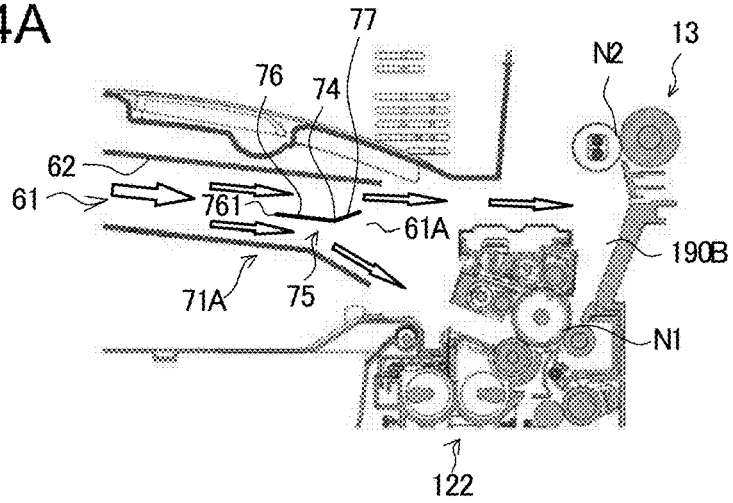
FIG. 14A to FIG. 14C are front cross-sectional views showing the outlet port of the air path and peripheral parts thereof.
Figure 14B:
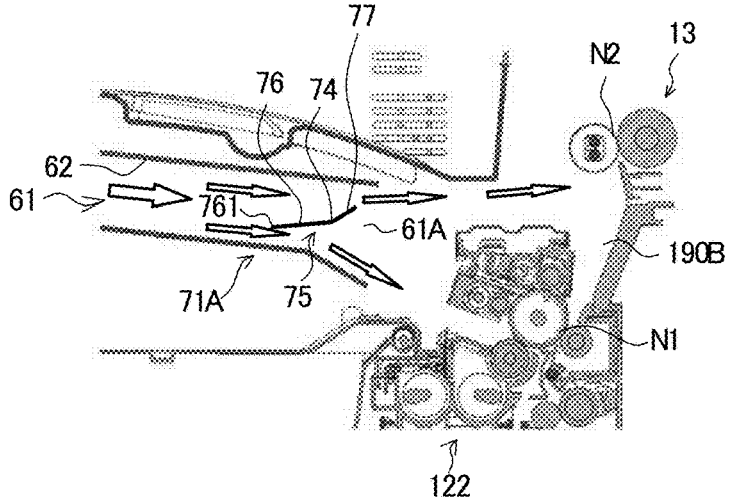
Figure 14C:
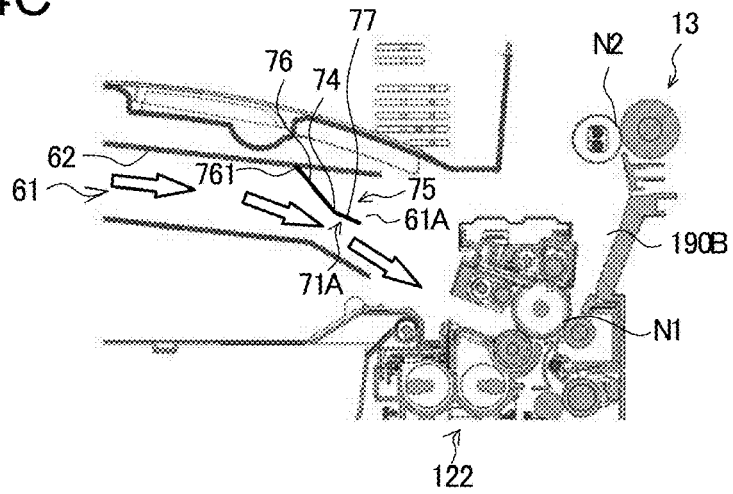

FIG. 14A to FIG. 14C are front cross-sectional views showing the outlet port 61A of the air path 61 and the peripheral parts thereof. FIG. 4A shows a state where the first oblique side section 76 is being parallel to the upper surface 62 of the inner wall of the air path 61. FIG. 14B shows a state where the second oblique side section 77 is coming near the upper surface 62 of the inner wall of the air path 61. FIG. 14C shows a state where the tip 761 the first oblique side section 76 is coming in contact with the inner wall of the air path. Each arrow illustrated in the drawings represents an air flow.

When the tip 761 of the first oblique side section 76 of the adjustment valve 75 is not in contact with the upper surface 62 of the inner wall of the air path 61, as shown in FIG. 14A and FIG. 14B, the air flowing through the air path 61 is branched into the direction toward the second conveyance path 190B and the direction toward the developing device 122.

On the other hand, when the tip 761 of the first oblique side section 76 of the adjustment valve 75 is in contact with the upper surface 62 of the inner wall of the air path 61 as shown in FIG. 4C, the flow of the air flowing toward the second conveyance path 190B is blocked, so that the volume of the air flowing into the developing device 122 increases.

Figure 15:
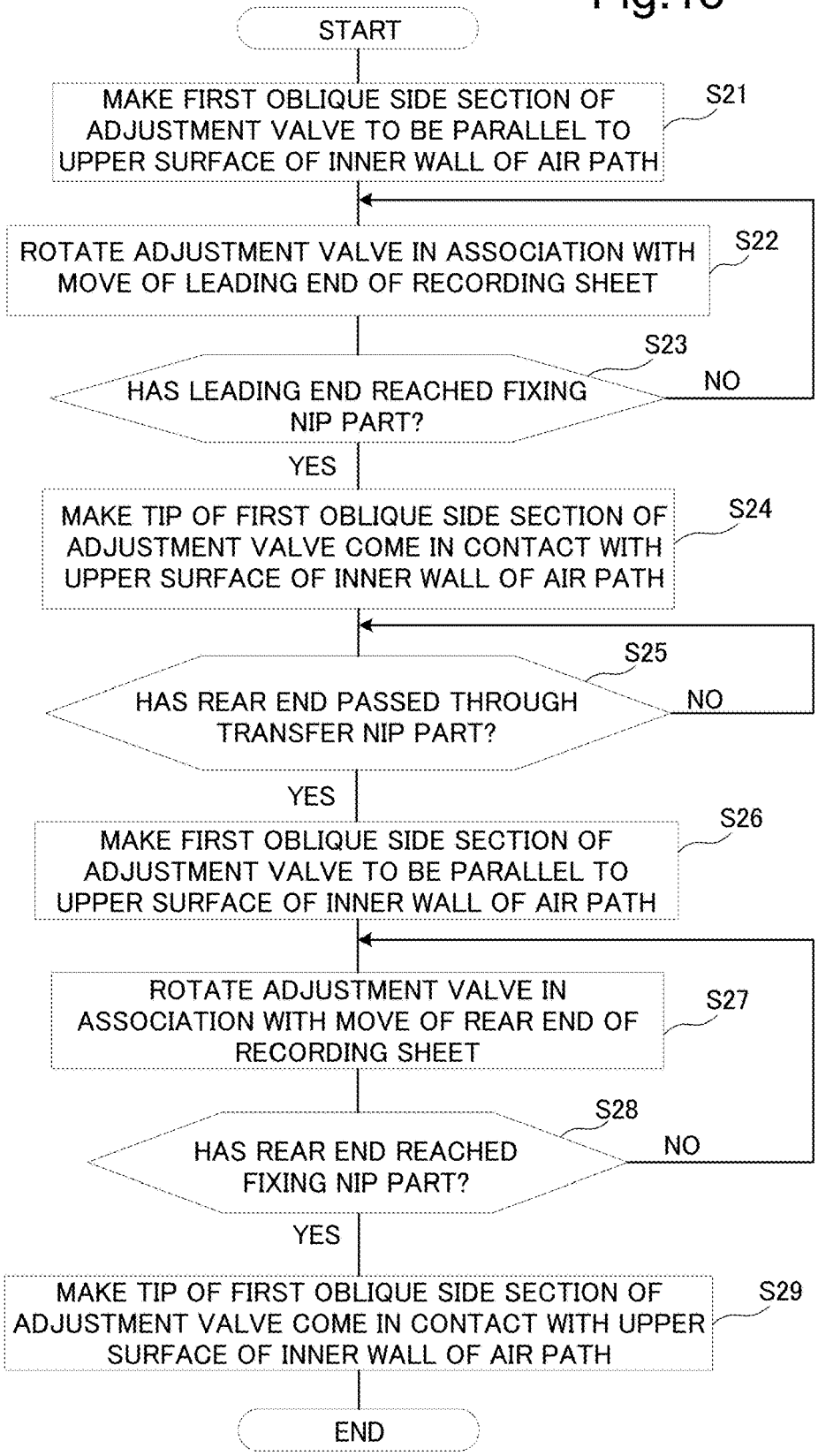
FIG. 15 is a flowchart showing an example of processing operation performed at the control unit of the image forming apparatus according to the third embodiment.

Based on a flowchart illustrated in FIG. 15, the descriptions will be given next for an example of processing operation performed at the control unit 10 with respect to the image forming apparatus 1 according to the third embodiment. The processing operation is performed when the control section 100 determines that the leading end of the recording sheet P has passed through the transfer nip part N1.

First, as shown in FIG. 14A, the control section 100 controls the adjustment member driving section 137 and rotates the adjustment valve 75 to thereby cause the first oblique side section 76 of the adjustment valve 75 to be parallel to the upper surface 62 of the inner wall of the air path 61 (S21). Next, the control section 100 controls the adjustment member driving section 137 in association with the move of the leading end of the recording sheet P, and as shown in FIG. 14B, and rotates the adjustment valve 75, to thereby change the position of the second oblique side section 77, so that the air flowing toward the second conveyance path 190B from the outlet port 61A is concentrated on the leading end of the recording sheet P (S22). For example, based on an elapsed time from a time point when the off-signal (the paper sheet presence signal) is received at the first paper sheet sensor 138, the elapsed time being measured by a timer incorporated, the control section 100 performs the control S22 on the adjustment member driving section 137.

Subsequently, the control section 100 determines whether the leading end of the recording sheet P has reached the fixing nip part N2 based on the signal outputted from the second paper sheet sensor 139 (S23), and upon determination that the leading end of the recording sheet P has not reached the fixing nip part N2 yet (NO in S23), the process returns to S22.

In contrast, upon determination that the leading end of the recording sheet P has reached the fixing nip part N2 (YES in S23), the control section 100 controls the adjustment member driving section 137 and rotates the adjustment valve 75, to thereby cause, as shown in FIG. 14C, the tip 761 of the first oblique side section 76 of the adjustment valve 75 to come in contact with the upper surface 62 of the inner wall of the air path 61 (S24).

The control section 100 then determines whether the rear end of the recording sheet P has passed through the transfer nip part N1 (S25). Upon determination that the rear end of the recording sheet P has passed through the transfer nip part N1 (YES in S25), the control section 100 controls the adjustment member driving section 137 and rotates the adjustment valve 75, to thereby cause, as shown in FIG. 14A, the first oblique side section 76 of the adjustment valve 75 to be parallel to the upper surface 62 of the inner wall of the air path 61 (S26). Following the processing, the control section 100 controls the adjustment member driving section 137 in association with the move of the rear end of the recording sheet P and rotates the adjustment valve 75, to thereby change the position of the second oblique side section 77, so that the air flowing toward the second conveyance path 190B from the outlet port 61A is concentrated on the rear end of the recording sheet P (S27).

Further, the control section 100 determines whether the rear end of the recording sheet P has reached the fixing nip part N2 (S28), and upon determination that the rear end of the recording sheet P has not reached the fixing nip part N2 yet (NO in S28), the process returns to S27.

In contrast, upon determination that the rear end of the recording sheet P has reached the fixing nip part N2 (YES in S28), the control section 100 controls the adjustment member driving section 137 and rotates the adjustment valve 75, to thereby cause, as shown in FIG. 14C, the tip 761 of the first oblique side section 76 of the adjustment valve 75 to come in contact with the upper surface 62 of the inner wall of the air path 61 (S29). The processing ends afterwards.

According to the second embodiment, when there is no recording sheet P in the second conveyance path 190B, the tip 761 of the first oblique side section 76 of the adjustment valve 75 is in contact with the upper surface 62 of the inner wall of the air path 61 as shown in FIG. 14C, so that the flow of the air flowing toward the second conveyance path 190B is blocked. Accordingly, the volume of the air flowing into the developing device 122 can be increased.

As shown in FIG. 14C, even if the recording sheet P exists in the second conveyance path 190B, when the recording sheet P is caught in both the transfer nip part N1 and the fixing nip part N2, and is in stable condition, the tip 761 of the first oblique side section 76 of the adjustment valve 75 still comes in contact with the upper surface 62 of the inner wall of the air path 61. Accordingly, the volume of the air flowing into the developing device 122 can be increased.

Furthermore, because the air flowing toward the second conveyance path 190B from the outlet port 61A can be concentrated on the leading end and the rear end of the recording sheet P in association with the move of the recording sheet P, the present embodiment is capable of stabilizing the behavior of the recording sheet P being conveyed through the second conveyance path 190B, so that the recording sheet P to the fixing section 13 can be more properly conveyed.

Figure 16A:
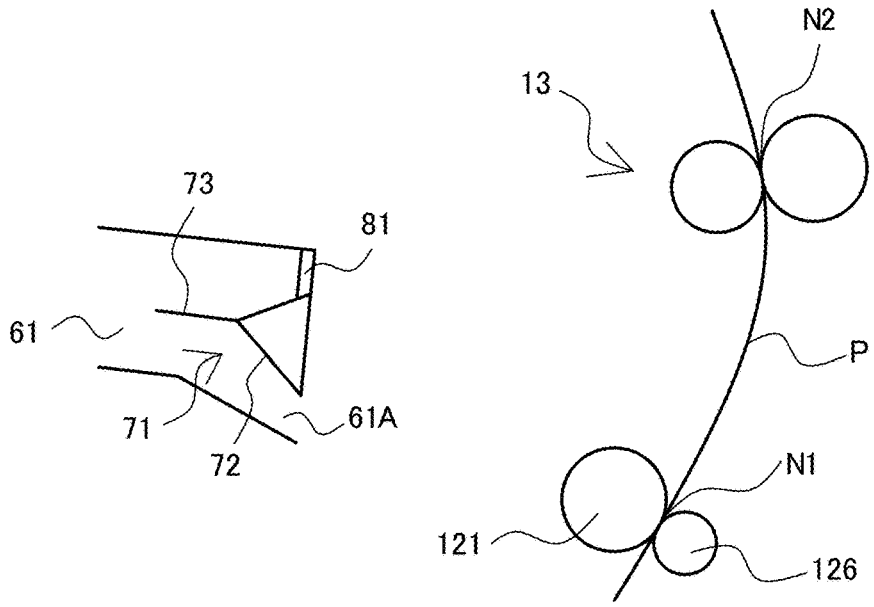
FIGS. 16A and 16B are views showing positional relations between the air path, a transfer nip part, a fixing nip part, and the recording sheet.
Figure 16B:
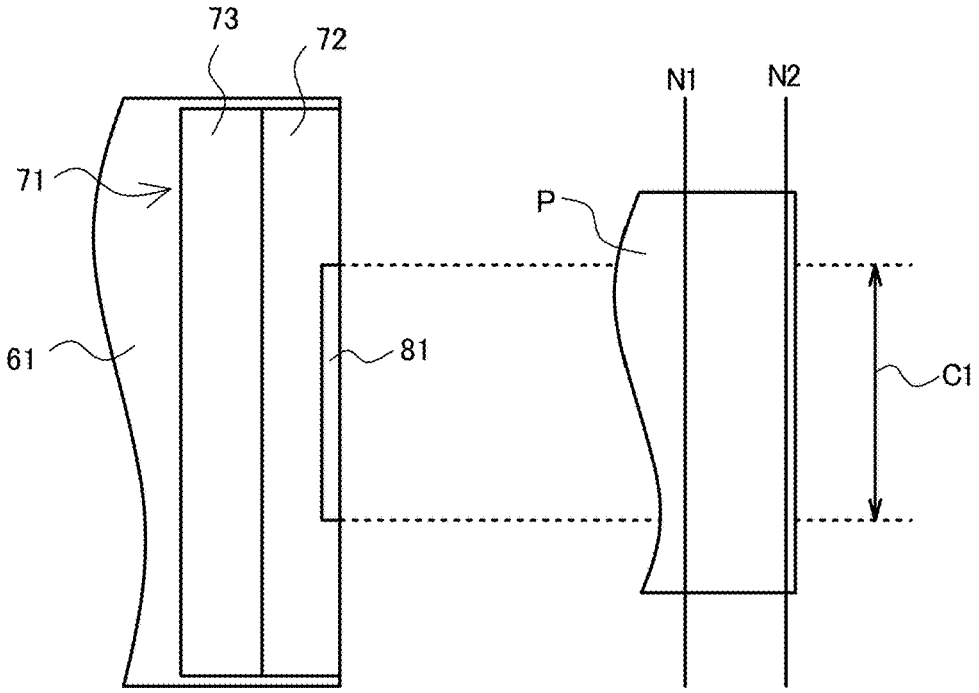

FIGS. 16A and 16B are views showing positional relations between the air path 61, the transfer nip part N1, the fixing nip part N2, and the recording sheet P passing through the fixing nip part N2. FIG. 16A is a schematic diagram when viewed from above, and FIG. 16B is a schematic diagram when viewed from front.

An unfixed toner image is formed on a center portion C1 in a width direction (axial direction) with respect to the conveyance direction of the recording sheet P. When strong wind is blown thereto, there is a risk of toner scattering. In this respect, as shown in FIGS. 16A and 16B, another embodiment in this disclosure may arrange, at the outlet port 61A, a blocking member 81 extending along with the width direction and facing against the center portion C1, and thus the air being blown from the outlet port 61A can be avoided from the center portion C1 of the recording sheet P.

Figure 17A:
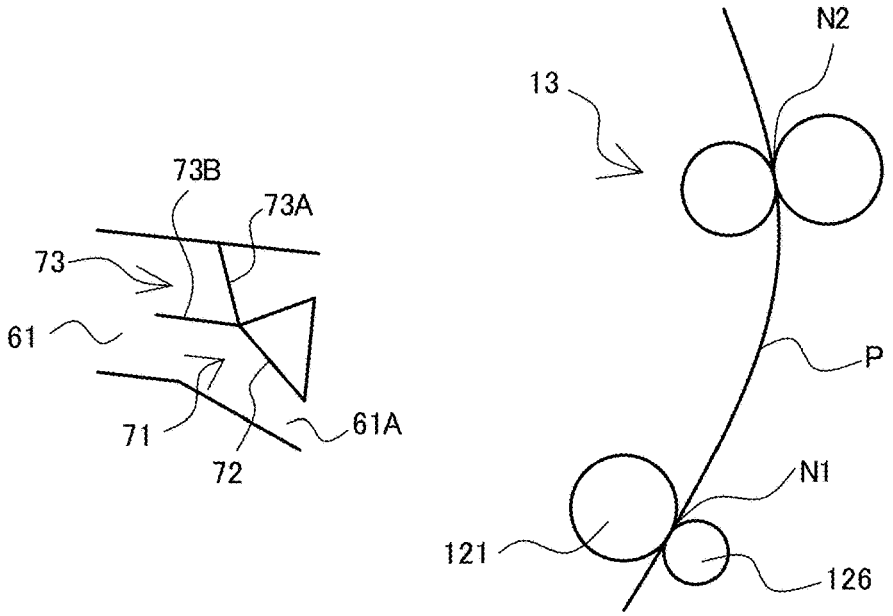
FIGS. 17A and 17B are views showing positional relations between the air path, the transfer nip part, the fixing nip part, and the recording sheet.
Figure 17B:
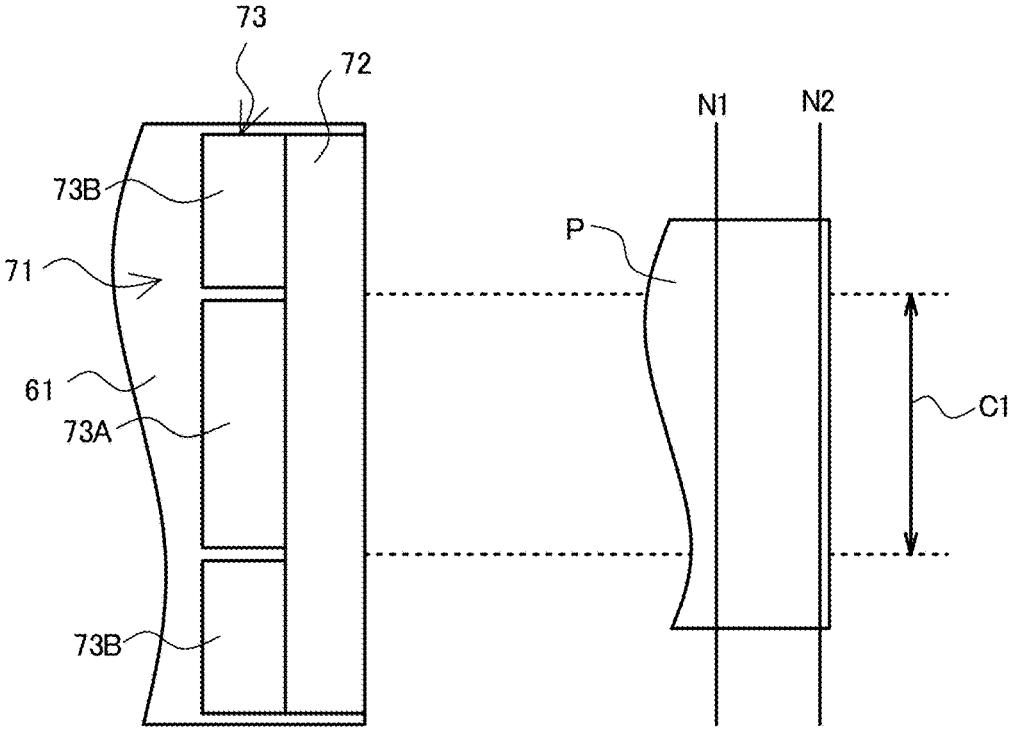

As shown in FIG. 17A and FIG. 17B, still another embodiment is arranged to include, for example: a center member 73A in which the adjustment valve 73 constituting the adjustment member 71 is arranged at the center portion C1 in the width direction (axial direction) of the recording sheet P moving through the second conveyance path 190B (not illustrated) formed between the transfer roller 126 and the fixing section 13; and an end member 73B which independently rotates from the center member 73A, and is arranged at the both end portions in the width direction of the recording sheet P, the position being where the center member 73A is not arranged.

When the control section 100 causes the adjustment member 71 to branch the air flowing through the air path 61 into the direction toward the second conveyance path 190B, as shown in FIG. 17A, the control section 100 may be arranged to rotate the center member 73A to thereby cause the center member 73A to branch the air in the center portion C1 in the width direction into the direction toward the developing device 122 (not illustrated) arranged at an upstream from the transfer roller 126 in the conveyance direction of the recording sheet P. At the same time, the control section 100 may be arranged to rotate the end member 73B so that the air in the both end portions in the width direction is branched to the direction toward the second conveyance path 190B.

With the processing described above, like the cases shown in FIG. 16A and FIG. 16B, the strong wind can be avoided from blowing to the center portion C1 in the width direction of the recording sheet P on which unfixed toner image is being formed, so that toner scattering can be reduced.

The present disclosure should not be limited to the configurations described in the embodiments but various modifications are applicable. Although the descriptions of the above embodiments are given taking a multifunction peripheral, as an example of the image forming apparatus according to the present disclosure, the example is merely illustrative and the image forming apparatus may be any other image forming apparatuses, such as a copier, a printer, and a facsimile.

The structure and processing described in the above embodiments with reference to FIG. 1 to FIG. 7B are merely illustrative of the present disclosure and the present disclosure is not intended to be limited to the above structure and processing.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier that rotates about a rotation axis and carries a toner image on a surface of the image carrier;

a developing device that supplies toner to the image carrier, and forms the toner image on the image carrier;

a transfer section that is arranged at downstream from the developing device in a rotation direction of the image carrier, and transfers the toner image onto a recording sheet at a transfer nip part formed between the transfer section and the image carrier;

a fixing section that is arranged at downstream from the transfer section in a conveyance direction of the recording sheet, and fixes the toner image having been transferred to the recording sheet on the recording sheet at a fixing nip part formed between a thermal roller and a compression roller;

an air path for guiding air taken from an outside of the image forming apparatus to the developing device; and a control section that, when operating the developing device under a cooling mode for cooling the developing device, controls the developing device and causes the developing device to reduce an amount of developer on a developing roller so as to be smaller than that of under image forming operation, wherein the developer is one-component developer, and under the cooling mode, the control section changes magnetic force of a magnetic pole included in the developing roller, thereby separating the developer from the developing roller and reducing the amount of the developer on the developing roller.

2. An image forming apparatus comprising;

an image carrier that rotates about a rotation axis and carries a toner image on a surface of the image carrier;

a developing device that supplies toner to the image carrier, and forms the toner image on the image carrier;

a transfer section that is arranged at downstream from the developing device in a rotation direction of the image carrier, and transfers the toner image onto a recording sheet at a transfer nip part formed between the transfer section and the image carrier;

a fixing section that is arranged at downstream from the transfer section in a conveyance direction of the recording sheet, and fixes the toner image having been transferred to the recording sheet on the recording sheet at a fixing nip part formed between a thermal roller and a compression roller;

an air path for guidance air taken from an outside of the image forming apparatus to the developing device; and a control section that, when operating the developing device under a cooling mode for cooling the developing device, controls the developing device and causes the developing device to reduce an amount of developer on a developing roller so as to be smaller than that of under image forming operation, wherein the developer is two-component developer, and under the cooling mode, the control section rotates the developing roller in a reverse direction relative to a direction under the image forming operation, thereby reducing the amount of the developer on the developing roller.

3. An image forming apparatus comprising:

an image carrier that rotates about a rotation axis and carries a toner image on a surface of the image carrier;

a developing device that supplies toner to the image carrier, and forms the toner image on the image carrier;

a transfer section that is arranged at downstream from the developing device in a rotation direction of the image carrier, and transfers the toner image onto a recording sheet at a transfer nip part formed between the transfer section and the image carrier;

a fixing section that is arranged at downstream from the transfer section in a conveyance direction of the recording sheet, and fixes the toner image having been transferred to the recording sheet on the recording sheet at a fixing nip part formed between a thermal roller and a compression roller;

an air path for guiding air taken from an outside of the image forming apparatus to the developing device; and a control section that, when operating the developing device under a cooling mode for cooling the developing device, controls the developing device and causes the developing device to reduce an amount of developer on a developing roller so as to be smaller than that of under image forming operation, wherein when the internal temperature of an apparatus body of the image forming apparatus becomes equals to or over the predetermined first temperature, the control section controls the operation of the developing device in the cooling mode, and when a predetermined time elapsed from a setting of the cooling mode, the control section releases the cooling mode.

* * * * *